US007021260B2

(12) United States Patent
Abe

(10) Patent No.: US 7,021,260 B2
(45) Date of Patent: Apr. 4, 2006

(54) ROCKER ARM

(75) Inventor: Katsufumi Abe, Iwata (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 11/143,640

(22) Filed: Jun. 3, 2005

(65) Prior Publication Data

US 2005/0241604 A1 Nov. 3, 2005

Related U.S. Application Data

(62) Division of application No. 10/939,407, filed on Sep. 14, 2004, which is a division of application No. 10/299,836, filed on Nov. 20, 2002, now Pat. No. 6,807,932.

(30) Foreign Application Priority Data

| | | |
|---|---|---|
| Nov. 22, 2001 | (JP) | 2001-357324 |
| Mar. 8, 2002 | (JP) | 2002-064300 |
| Jul. 2, 2002 | (JP) | 2002-193649 |
| Jul. 2, 2002 | (JP) | 2002-193650 |
| Jul. 2, 2002 | (JP) | 2002-193651 |

(51) Int. Cl.
*F01L 1/18* (2006.01)

(52) U.S. Cl. ..... 123/90.39; 123/90.4; 74/569; 29/888.2

(58) Field of Classification Search ..... 123/90.16, 123/90.39, 90.4, 90.41, 90.44, 90.6; 74/559, 74/569; 29/888.2
See application file for complete search history.

(56) References Cited

U.S. PATENT DOCUMENTS

| | | | | |
|---|---|---|---|---|
| 5,357,916 A | | 10/1994 | Matterazzo | 123/90.16 |
| 5,678,305 A | * | 10/1997 | Nagano et al. | 29/888.2 |
| 5,799,546 A | | 9/1998 | Pryba | |
| 6,035,820 A | | 3/2000 | Engelhardt et al. | |
| 6,283,077 B1 | | 9/2001 | Kotani et al. | 123/90.39 |
| 6,601,555 B1 | * | 8/2003 | Okubo et al. | 123/90.39 |

(Continued)

FOREIGN PATENT DOCUMENTS

DE 32154291 11/1983

(Continued)

OTHER PUBLICATIONS

U.S. Appl. No. 10/299,836, filed Nov. 20, 2002, Katsufumi Abe, NTN Corporation.

(Continued)

*Primary Examiner*—Thomas Denion
*Assistant Examiner*—Ching Chang

(57) ABSTRACT

A rocker arm 1 includes an arm body 4 prepared from a single plate material by means of a press work. The arm body 4 includes a pair of parallel side walls 5 and a connecting wall 6 bridging between the opposite side walls 5 and also having a pivot support hole 7 defined at a location generally intermediate of the length of the arm body 4. A roller support pin for rotatably supporting a roller 10 for driving engagement with a cam is mounted on one ends 1*a* of the opposite side walls 5, while the opposite end 1*b* of the connecting wall 6 defines an overlapped structure 13 formed by bending an end overlap piece 12, extending integrally from a side edge of the connecting wall 6, backwardly to overlap the connecting wall 6. This overlapped structure 13 in turn defines an adjustment element 16 having a mounting hole 15 defined therein for adjustably receiving a valve driving member 14. The rocker arm 1 may be designed to be an end pivot type, in which case the adjustment element 16 is provided with a pivot member.

10 Claims, 24 Drawing Sheets

U.S. PATENT DOCUMENTS

| | | | | |
|---|---|---|---|---|
| 6,807,932 | B1 | 10/2004 | Abe | 123/90.39 |
| 6,863,040 | B1 | 3/2005 | Kataoka et al. | 123/90.39 |

FOREIGN PATENT DOCUMENTS

| | | |
|---|---|---|
| DE | 197 10 867 A1 | 9/1998 |
| JP | 63272903 | 11/1988 |
| JP | 10-299430 | 11/1998 |
| JP | 2001-003715 | 1/2001 |
| JP | 2001-041011 | 2/2001 |
| JP | 2001-065316 | 3/2001 |
| JP | 2001-132414 | 5/2001 |

OTHER PUBLICATIONS

U.S. Appl. No. 10/939,407, filed Sep. 14, 2004, Katsufumi Abe, NTN Corporation.

* cited by examiner

ROCKER ARM

CROSS-REFERENCE TO RELATED APPLICATIONS

This application is a divisional of application Ser. No. 10/939,407, filed Sep. 14, 2004, allowed, which is a divisional of U.S. Ser. No. 10/299,836, filed Nov. 20, 2002, now U.S. Pat. No. 6,807,932.

This application is based upon and claims the priority of Japanese application nos. 2001-357324, filed Nov. 22, 2001, 2002-064300, filed Mar. 8, 2002, 2002-193649, filed Jul. 2, 2002, 2002-193650, filed Jul. 2, 2002, 2002-193651, filed Jul. 2, 2002, and U.S. patent application Ser. No. 10/299,836, filed Nov. 20, 2002 and U.S. patent application Ser. No. 10/939,407, filed Sep. 14, 2004, the contents being incorporated herein by reference.

BACKGROUND OF THE INVENTION

1. Field of the Invention

The present invention generally relates to a rocker arm of a center pivot type or an end pivot type adapted to be driven by a cam mounted on an internal combustion engine for selectively opening and closing a valve of a cylinder head and, more particularly, to the rocker arm prepared from a plate member such as a steel plate by the use of a press work.

2. Description of the Prior Art

A rocker arm utilized in a valve drive mechanism of an internal combustion engine has hitherto been manufactured by the use of a casting technique and, therefore, the manufacture of the rocker arm involves a number of problems to be solved such as those associated with considerable weight of the manufactured rocker arm, a relatively large number of manufacturing steps and a high cost of manufacture. In contrast thereto, the rocker arm of a plate type prepared from a shaped plate that is manufactured from a plate material of a relatively small thickness by the use of a press work has now come to be largely employed because of a light-weight feature, a relatively small number of manufacturing steps and a low cost of manufacture.

The rocker arm currently in use is generally available in two types; a center pivot type, in which the rocker arm is rockingly supported at a generally intermediate portion thereof, and an end pivot type in which the rocker arm is pivotally supported at one of its opposite ends through a pivot element secured to such one of the opposite ends. The rocker arm of the plate type is generally employed for both of the center pivot type and the end pivot type.

The center pivot type is of a design in which a valve driving member is adjustably fitted in a screw hole of an adjustment element formed in an arm body so that an adjustment can be made among a cam, a valve and a rocker arm. On the other hand, the end pivot type is of a design in which a pivot element is adjustably fitted in a screw hole of an adjustment element formed in an arm body so that an adjustment can be made among a cam, a valve and a rocker arm.

The center pivot type and the end pivot type differ from each other depending on which one of the valve driving member and the pivot element is used as an element to be mounted. However, both of those types employ the adjustment element and, accordingly, if the rocker arm is prepared by the use of a plate member of a relatively small thickness, a sufficient depth can hardly be obtained in the mounting hole for the adjustment element and a problem associated with securement of a sufficient strength around the mounting hole tends to arise.

By way of example, FIG. 30 illustrates the conventional center pivot type rocker arm such as disclosed in, for example, the Japanese Laid-open Patent Publication No. 2001-41011. The conventional rocker arm 51 shown therein includes an arm body 52 prepared from a single plate member by the use of a press work. The arm body 52 has a generally inverted U-shaped section defined by a pair of parallel side walls 53 and a connecting wall 54 bridging between respective upper edges of the side walls 53. One end of the connecting wall 54 that defines the adjustment element is formed with a female-threaded mounting hole 55 defined therein for adjustably receiving a valve driving member (not shown) therein. This mounting hole 55 is reinforced by formation of a cylindrical bulged portion 56 so that the valve driving member can be firmly retained. Also, when the rocker arm 51 is so designed that the respective centers of the adjustment element and a roller support structure is offset axially, the cylindrical bulged portion 56 will interfere with the side walls 53 unless any other measure is taken and, therefore, an open window 57 is defined in one of the side walls 53 on an offset side so as to avoid the interference.

While in the conventional rocker arm shown in FIG. 30 the cylindrical bulged portion 56 is formed in the mounting hole 55 in the connecting wall 54 to secure a required depth of the mounting hole 55, formation of the mounting hole 55 is complicated and time-consuming because of the cylindrical bulged portion 56 so formed. Where the offset structure is employed, the open window 57 is defined to avoid interference with the cylindrical bulged portion 56, but the amount of offset is limited only with a play afforded by the open window 57.

Also, in this conventional rocker arm, if the arm body 52 of a relatively large thickness is employed, a sufficient strength can be secured around pivot support holes 58 defined in the respective side walls 53. However, since the plate thickness of the entire arm body 52 of the generally inverted U-shaped section increases, the connecting wall 54 which does not require a relatively high strength will have a correspondingly increased thickness, resulting in inconvenience in reducing the overall weight of the arm body. In addition, the amount of material used to manufacture the arm body will unnecessarily increase.

FIG. 31 illustrates the conventional rocker arm of the end pivot type such as disclosed in, for example, the Japanese Laid-open Patent Publication No. 2001-132414. This conventional rocker arm 81 includes an arm body 82 of a generally inverted U-shaped section having one end thereof provided with an end overlap piece 83 extending in a direction lengthwise of the arm body 82, which overlap piece 83 is turned backwardly to define an adjustment element of an overlapped structure. A mounting hole 85 is defined in this adjustment element of the overlapped structure, in which a pivot member (not shown) is adjustably inserted. Since in this example, the adjustment element is of the overlapped structure, a sufficient strength can be secured around the mounting hole 85.

However, since the end overlap piece 83 has to be turned backwardly and a step of turning the end overlap piece 83 backwardly, which is separate from a step of shaping the arm body 82 so as to have a generally inverted U-shaped section, is required, the number of manufacturing steps consequently increases, resulting in increase of the manufacturing cost.

Also, in order for the mounting hole 85 to be formed after the end overlap piece 83 has been turned backwardly, the distance L from the mounting hole 85 to a bent portion at which the end overlap piece 83 is turned backwardly as shown in FIG. 31 has to be somewhat large. In other words, since a bending process is employed to turn the end overlap piece 83 backwardly, degradation of material occurs in a portion of the end overlap piece 83 and/or the connecting wall 84 adjacent the bent portion and, therefore, they are not suited to formation of the mounting hole 85. Particularly where the mounting hole 85 is employed in the form of an internally threaded screw hole, inconveniences will undoubtedly arise. For this reason, it is necessary to provide a sufficient margin which enables the arm body to overcome detrimental effects possibly brought about by the degradation of material. Since as discussed above the front end portion of the arm body 82 is required to have an increased length inclusive of the above mentioned margin, the rocker arm 81 as a whole has a correspondingly increased length, far from being manufactured compact. Even where the adjustment element of the overlapped structure defined by the end overlap piece 83 is applied to the center pivot type shown in and described with reference to FIG. 30, a similar problem associated with the lengthwise dimension as discussed above will arise.

FIG. 32 illustrates the center pivot type rocker arm suggested in, for example, the Japanese Laid-open Patent Publication No. 10-299430. A rocker arm 61 shown therein is of a generally folded structure formed by bending an elongated plate member about a substantially intermediate portion 61*b* thereof so as to define two side walls 63 and 64, with the bent portion 61*b* defining an adjustment element in which a valve driving member (not shown) is adjustably inserted.

In this conventional rocker arm of the center pivot type shown in FIG. 32, a mounting hole 75 defined in the adjustment element can be formed to have a relatively great depth, but since the arm body is defined only by the mutually confronting side walls 63 and 64, means is required to regulate the space between the side walls 63 and 64 to a predetermined or required value. It is to be noted that the side walls 63 and 64 are formed with respective cylindrical bulged portions 70 positioned around associated pivot support holes 69 and, accordingly, a sufficient strength can be secured even though the rocker arm 61 is prepared from a thin plate material. However, formation of the cylindrical bulged portions 70 is indeed time-consuming and laborious.

Also, since in the conventional rocker arm 61 shown in FIG. 32, there is no means by which the space between the side walls 63 and 64 is regulated to a predetermined or required value, an extra space regulating means is required.

While in describing the prior art believed to be pertinent to the present invention reference has been made to the center pivot type, similar problems to those discussed above equally applies even to the rocker arm of the end pivot type.

SUMMARY OF THE INVENTION

The present invention is intended to provide a rocker arm of a kind wherein a sufficient strength can be secured around a mounting hole defined in an adjustment element with a simplified manufacturing, and which is assembled less costly and light-weight with a minimized number of manufacturing steps and can have a reduced length. This object of the present invention can be achieved by the rocker arm as set forth in the appended claims.

Another object of the present invention is to provide a rocker arm of a kind wherein the amount of offset can easily be adjusted without changing the width of an arm body and only with changing a widthwise dimension of the adjustment element. A still another object of the present invention is to provide a rocker arm wherein a sufficient strength can be secured around respective pivot support portions of opposite side walls by a simplified manufacturing step.

A further object of the present invention is to facilitate an offset structure to be designed easily.

A still further object of the present invention is to provide a rocker arm of an end pivot type in which a sufficient strength can be secured in each of the opposite side walls, and which can be manufactured light-weight and less costly with a reduced number of manufacturing steps.

To these ends, the rocker arm according to any one of first to sixth aspects of the present invention is rocked by a cam to actuate a valve of an internal combustion engine and, for this purpose, is of a design in which an arm body of the rocker arm is prepared from a single plate material by means of a press work so as to be constructed of a pair of side walls opposite to each other and a connecting wall bridging between the opposite side walls.

Of the rocker arms according to the first to sixth aspects of the present invention, the rocker arm according to the first aspect of the present invention is of a center pivot type and is so constructed as follows.

The arm body has first and second ends opposite to each other and also has a pivot support portion defined at a location generally intermediate of the length of the arm body. A roller is rotatably mounted on the first end of the arm body for driving engagement with the cam, and an adjustment element is defined on the second end of the arm body. Specifically, the adjustment element is defined by an overlapped structure that includes an end overlap piece formed integrally with a side portion of the connecting wall adjacent the second end of the arm body and bent backwardly to overlap the connecting wall to thereby define the adjustment element. The adjustment element has a mounting hole defined therein for adjustably receiving therein a valve driving member.

According to the first aspect of the present invention, since the adjustment element is defined by the overlapped structure formed by overlapping the end overlap piece against the connecting wall, a sufficient depth can be secured in the mounting hole extending through the adjustment element, resulting in the securement of a sufficient strength around the mounting hole defined in the adjustment element. In such case, the adjustment element of the overlapped structure is formed by overlapping the end overlap piece against the connecting wall, processing to reinforce is easy to achieve. Also, since the adjustment element is defined by the end overlap piece extending from the side portion of the connecting wall, the dimension of the margin required to avoid a deteriorated portion in the vicinity of a bent portion occurring in a direction widthwise of the arm body can be secured in the widthwise direction of the arm body. Because of this, the overall length of the arm body will not increase to provide the overlapped structure, making the arm body compact in the lengthwise direction. With respect to the direction widthwise of the arm body, because of securement of the widthwise dimension of the roller held in rolling contact with the cam, a sufficient margin can be obtained relative to the inner diameter of the mounting hole and, therefore, there is no need to increase the width of the arm body. Also, since the rocker arm is prepared from a single plate material by the use of any known press work, it is light-weight and less costly with the number of manufacturing steps reduced.

The mounting hole referred to above may be displaced relative to a center of the connecting wall in a widthwise direction thereof. Where the offset structure is designed by such displacement, a sufficient amount of offset can be secured since no cylindrical bulged portion such as employed in the prior art rocker arms is employed therein.

The width of the overlapped structure in a widthwise direction of the connecting wall may be increased to a value greater than that of the connecting wall. While the width of the overlapped structure defining the adjustment element need not be increased in view of a margin for providing a bending or folding, increase of the width of the overlapped structure allows the amount of offset between the adjustment element and the roller support structure to be chosen arbitrarily as desired without changing the widthwise dimension of a main portion of the arm body, but only with changing the widthwise dimension of the adjustment element. Accordingly, without accompanying a considerable increase of the weight of the rocker arm, the relatively large amount of offset can be secured.

The rocker arm according to the second aspect of the present invention is of an end pivot type and is so constructed as follows.

Specifically, the arm body of the rocker arm of the end pivot type includes a roller rotatably mounted on a portion generally intermediate of the length of the arm body for driving engagement with the cam. A valve driving member is formed in the first end of the arm body for driving engagement with the valve, and an overlapped structure is formed on the second end of the arm body. This overlapped structure includes an end overlap piece formed integrally with a portion of the connecting wall adjacent the second end of the arm body, said end overlap piece being bent backwardly to overlap the connecting wall to thereby define an adjustment element having a mounting hole defined therein for adjustably receiving therein a pivot member.

Although the rocker arm according to the second aspect of the present invention differs from that according to the first aspect of the present invention in that a member mounted on the adjustment element in the rocker arm according to the second aspect of the present invention is the pivot member, the following effects similar to those afforded by the rocker arm according to the first aspect of the present invention can be obtained. Specifically, since the adjustment element is defined by the overlapped structure formed by overlapping the end overlap piece against the connecting wall, a sufficient depth can be secured in the mounting hole in the adjustment element, resulting in the securement of a sufficient strength around the mounting hole defined in the adjustment element. In such case, the adjustment element of the overlapped structure is formed only by overlapping the end overlap piece over the connecting wall, processing to reinforce is easy to achieve. Also, since the adjustment element of the overlapped structure is formed by the end overlap piece extending from the side portion of the connecting wall, the dimension of the margin required to avoid a deteriorated portion in the vicinity of a bent portion occurring in a direction widthwise of the arm body can be secured in the widthwise direction of the arm body. Because of this, the overall length of the arm body will not increase to provide the overlapped structure. With respect to the direction widthwise of the arm body, because of securement of the widthwise dimension of the roller held in rolling contact with the cam, a sufficient margin can be obtained relative to the inner diameter of the mounting hole and, therefore, there is no need to increase the width of the arm body. Also, since the rocker arm is prepared from a single plate material by the use of any known press work, it is light-weight and less costly with the number of manufacturing steps reduced.

According to the present invention, in either of the rocker arm according to the first aspect of the present invention and that according to the second aspect of the present invention, the end overlap piece may be provided in a plural number, in which case the plural end overlap pieces are bent one at a time to overlap one above the other to thereby define the overlapped structure having three or more overlapping layers. Where the plural end overlap pieces are used to form the overlapped structure, the thickness of the overlapped structure can be increased and, hence, that of the adjustment element can have a correspondingly increased strength.

Also, the end overlap piece overlapping the connecting wall may be welded to the connecting wall and/or a free end of the end overlap piece may be inserted into an engagement opening defined in one of the side walls so that the overlapped structure defining the adjustment element can have an increased strength.

The mounting hole defined in the adjustment element may be an internally threaded hole. Where the internally threaded hole is used for the mounting hole, a portion of the arm body around the mounting hole must have a sufficient strength to secure the sufficient strength of threads forming the internally threaded hole and, for this purpose, a sufficient marginal dimension has to be secured in the vicinity of the, bending portion. However, in the present invention, since the end overlap piece extends from the side portion of the connecting wall, there should arrive no problem associated with increase of, for example, the length of the arm body.

At least a portion of one or both of the side walls of the arm body may be configured to represent an overlapped structure defined by bending a portion of the plate material. Where this overlapped structure in which that portion of one or both of the side walls is bent to overlap is employed, a portion where the strength is required can be selectively reinforced and a sufficient strength can be obtained even if a relatively thin plate material is employed. In particular, in the first aspect of the present invention, that is, in the case of the rocker arm of the center pivot type, when a portion of the side wall adjacent the pivot support portion is so configured to represent the overlapped structure in which a portion of the plate material is bent to overlap, a sufficient strength of the portion of the side walls in the vicinity of the pivot support portion where the strength is required can be secured with no need to increase the plate thickness. Because of the overlapped structure employed, processing to increase the strength is much simple and easy to achieve.

The rocker arm according to the third aspect of the present invention is of a center pivot type and is so constructed as follows.

The arm body has a pivot support portion defined at a location generally intermediate of the length of the arm body, and a roller is rotatably mounted on the first end of the arm body and is engageable with the cam. An adjustment element is formed on the second end of the arm body and has a female thread defined therein, and a valve driving member having a male thread is adjustably inserted in the adjustment element with the male thread engaged with the female thread. The female thread is made up of an internally threaded hole extending through the connecting wall and a partially threaded portion defined in an inner surface of each of the opposite side walls in continuation with the internally threaded hole.

The female thread in which the valve driving member is fitted is made up of the internally threaded hole formed in the connecting wall forming a ceiling of the adjustment element of a generally inverted U-shaped section and the partially threaded portions formed respectively in the mutually confronting surfaces of the opposite side walls in continuation with the internally threaded hole and, accordingly, the male thread of the valve driving member can be threadingly engaged with the opposite side walls. Because of this, a threading strength of the female thread for receiving the valve driving member can be secured. Hence, no use of, for example, any overlapped structure or wall of an increased thickness is needed for reinforcement of the screw hole. Thus, while the number of the manufacturing steps is reduced, a sufficient strength can be secured around the threaded hole in the adjustment element and it is possible to manufacture the light-weight rocker arm at a low cost with minimized number of the manufacturing steps.

Also, since the adjustment element is defined by a reduced width portion of a generally inverted U-shaped section or a generally U-shaped section and, therefore, a necessary strength can be secured. Yet, since the inverted U-shaped section or the U-shaped section assumed by the reduced width portion defining the adjustment element is similar to that represented by the arm body, processing is easy to achieve.

In this structure, a portion of one or both of the opposite side walls adjacent the pivot support portion may be configured to represent an overlapped structure formed by bending a portion of the plate material.

Where as hereinabove described that portion of the side wall adjacent the pivot support portion is configured to represent the overlapped structure, a sufficient strength of that portion of the side walls around the pivot support portion where the strength is required can be secured with no need to increase the plate thickness. Because of the overlapped structure employed sufficiently, processing to increase the strength is much simple and easy to achieve.

The side wall of the overlapped structure may be made up of a first side wall forming plate segment continued from the connecting wall and defining that portion of the side wall adjacent the pivot support portion, and a second side wall forming plate segment extending integrally from the first side wall forming plate segment and bent to overlap the first side wall forming plate segment, with a roller support hole defined in a free end of the second side wall forming plate segment for supporting the roller. In this case, the overlapped structure may be defined only in one of the opposite side wall.

In the case of this structure, since only one of the opposite side walls represents the overlapped structure and the roller support hole is defined in the second side wall forming plate segment that is bent to overlap the first side wall forming plate segment, an offset structure can easily be obtained in which the center of the adjustment element and the center of a roller support structure are displaced in a direction of a pivot support pin.

Also, the rocker arm according to the fourth aspect of the present invention is of an end pivot type and is so constructed as follows.

The arm body of this rocker arm includes a roller rotatably mounted on a portion generally intermediate of the length of the arm body for driving engagement with the cam, and a valve driving member formed in a first end of the arm body for driving engagement with the valve. An adjustment element is defined on a second end of the arm body and has a female thread defined therein. A pivot member having a male thread is adjustably inserted in the adjustment element with the male thread engaged with the female thread. This female thread referred to above is made up of an internally threaded hole extending through the connecting wall and a partially threaded portion defined in an inner surface of each of the opposite side walls in continuation with the internally threaded hole.

The female thread in which the pivot member is fitted is made up of the internally threaded hole formed in the connecting wall forming a ceiling of the adjustment element of a generally inverted U-shaped section and the partially threaded portions formed respectively in the mutually confronting surfaces of the opposite side walls in continuation with the internally threaded hole and, accordingly, the male thread of the pivot member can engage with the opposite side walls. Therefore, no use of any overlapped structure or wall of an increased thickness is needed for reinforcement of the threaded hole. Thus, while the number of the manufacturing steps is reduced, a sufficient strength can be secured around the threaded hole in the adjustment element while the number of manufacturing steps is reduced.

Even with this structure, since the adjustment element is defined by a reduced width portion of a generally inverted U-shaped section or a generally U-shaped section and, therefore, a necessary strength can be secured. Yet, since the inverted U-shaped section or the U-shaped section assumed by the reduced width portion defining the adjustment element is similar to that represented by the arm body, processing is easy to achieve.

According to the fifth aspect of the present invention, the rocker arm is of a center pivot type and is so constructed as follows.

The arm body of the rocker arm according to the fifth aspect of the present invention has a pivot support portion defined at a location generally intermediate of the length of the arm body and a roller is rotatably mounted on a first end of the arm body and engageable with the cam while an adjustment element is formed on a second end of the arm body for adjustably receiving a valve driving member therein. At least a portion of one or both of the opposite side walls adjacent the pivot support portion is configured to represent an overlapped structure formed by bending a portion of the plate material.

According to this structure, since that portion of the side wall adjacent the pivot support portion is configured to represent the overlapped structure, a sufficient strength of that portion adjacent the pivot support portion where the strength is required can be secured with no need to increase the plate thickness. Because of this, a portion of the connecting wall where the strength requirement is relatively low will not unnecessarily increase in thickness and, therefore, while the arm body is designed to have a light-weight feature with reducing the materials used, the rocker arm can be manufactured inexpensively with the number of manufacturing steps reduced and, also a sufficient strength can be secured around the pivot support portion. Also, because of the overlapped structure employed, processing to increase the strength is much simple and easy to achieve.

Where that portion of the side wall adjacent the pivot support portion is configured to represent the overlapped structure, such overlapped structure of the side wall may be formed by providing a side overlap piece extending integrally from the side wall and then bending it to overlap the side wall. Where the use is made of the side overlap piece which is eventually bent to overlap the side wall to provide the overlapped structure, it can be accomplished with a simplified processing.

The side wall of the overlapped structure referred to above may include a first side wall forming plate segment continued from the connecting wall and defining that portion of the side wall adjacent the pivot support portion, and a second side wall forming plate segment extending integrally from the first side wall forming plate segment and bent to overlap the first side wall forming plate segment, with a roller support hole defined in a free end of the second side wall forming plate segment for supporting the roller. Even with this configuration, the overlapped structure can easily be obtained with a simplified processing Also, in the case of this configuration, since the roller is mounted on the second side wall forming plate segment, and if the overlapped structure is defined only in one of the opposite side walls, an offset structure can be obtained in which the center of the adjustment element and the center of the roller support structure are displaced in a direction of a pivot support pin.

Without the first side wall forming plate segment and the second side wall forming plate segment being tightly overlapped one above the other, they may be separated in a direction of the pivot support pin in the arm body. In such case, by suitably choosing the distance of separation between the first and second side wall forming plate segments, the amount of offset required to realize the offset structure can be adjusted as desired.

According to the sixth aspect of the present invention, the rocker arm is of an end pivot type and is so constructed as follows.

The arm body of the rocker arm according to the sixth aspect of the present invention has a roller rotatably mounted on a portion generally intermediate of the length of the arm body for driving engagement with the cam and, also, a valve driving member formed in a first end of the arm body for driving engagement with the valve while an adjustment element is formed on a second end of the arm body for adjustably receiving a pivot member therein. At least a portion of one or both of the opposite side walls adjacent the pivot support portion is configured to represent an overlapped structure formed by bending a portion of the plate material. The overlapped structure in the side wall is formed where a strength requirement is high, for example, where a mounting hole for the roller is formed and/or a lengthwise range of the side walls on which the valve driving member acts.

Even with this configuration, a sufficient strength can be obtained at a portion of the side wall where it is required, with no need to increase the plate thickness. For this reason, the thickness of a portion of the connecting wall where the strength requirement is relatively low will not increase unnecessarily and, hence, while the arm body is designed to have a light-weight feature with reducing the materials used, a sufficient strength can be secured. Also, since that portion of the side wall of the arm body is simply bent to provide the overlapped structure, the rocker arm according to the sixth aspect of the present invention is light-weight and less costly with the number of manufacturing steps reduced and, at the same time has an increased strength around a pivot support portion where the rocker arm is pivotably supported.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
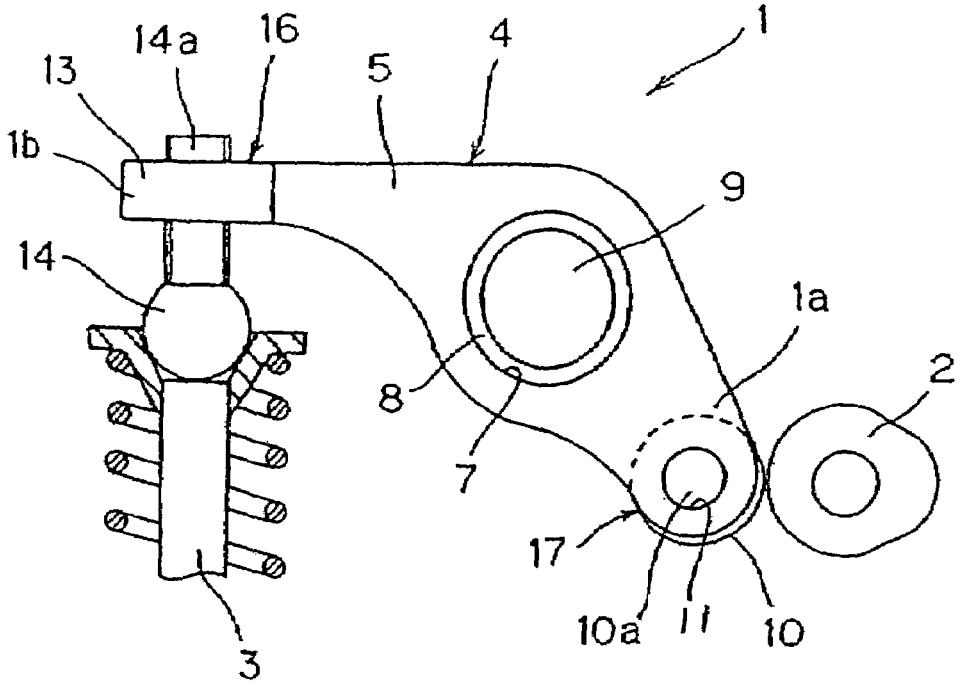
FIG. 1 is a front elevational view showing a first preferred embodiment of a rocker arm according to a first aspect of the present invention, shown together with a peripheral structure of an internal combustion engine.

One preferred embodiment of a rocker arm according to a first aspect of the present invention (First Embodiment) will be described with particular reference to FIGS. 1 and 2. As shown in FIG. 1, the rocker arm 1 shown therein is of a center pivot type that is mounted on an engine (not shown) and has a first or rear end 1*a* driven by a cam 2 so that the rocker arm 1 can undergo a rocking motion with the opposite, second or front end 1*b* used to open and close a valve 3 of a cylinder head. This rocker arm 1 includes an arm body 4 made from a single plate material such as, for example, a single steel plate by the use of any known press work so as to represent a generally inverted U-shaped section defined by a pair of opposite side walls 5 and a connecting wall 6 (FIG. 3) straddling between respective upper edges of the side walls 5. The arm body 4 may have either a straight side view or a curved or angled side view, but in the illustrated embodiment the arm body 4 represents a substantially angled side configuration. Except for a portion adjacent the front end 1*b*, the side walls 5 are of a substantially symmetrical shape with each other. The connecting wall 6 straddling between the side walls 5 is so formed as to extend from a portion of the arm body 4 adjacent the rear end 1*a* to the front end 1*b*.

The side walls 5 have respective pivot support holes 7 defined therein at a location generally intermediate of the length thereof, and the rocker arm 1 is rockingly supported by a pivot support pin 9 inserted into the pivot support holes 7 through a bushing 8. Thus, the rocker arm 1 can undergo a rocking motion about the pivot support pin 9 in respective directions opposite to each other. The bushing 8 is, for example, press-fitted into the pivot support holes 7. The rear ends 1*a* of the side walls 5 have respective roller support holes 11 defined therein, and a roller 10 engageable with the cam 2 (FIG. 1) is rotatably supported on a support pin 10*a* having its opposite ends journalled in the associated roller support holes 11 and positioned between the rear ends 1*a* of the side walls 5. The rear ends 1*a* of the side walls 5 carrying the support pin 10*a* constitutes a roller support structure 17.

Figure 2A:
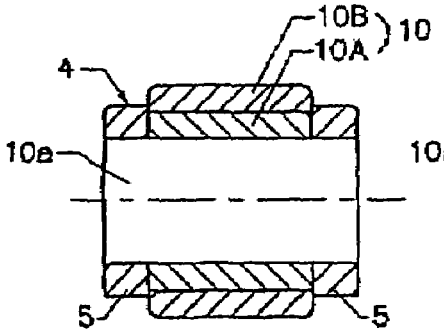
FIG. 2A is a transverse sectional view showing a roller support structure employed in the rocker arm shown in FIG. 1.
Figure 2B:
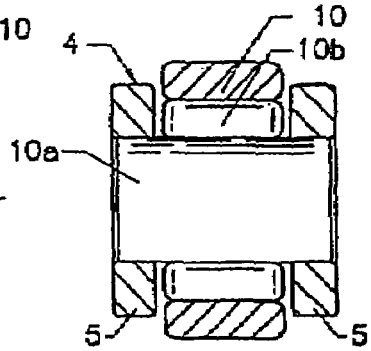
FIGS. 2B and 2C are transverse sectional views showing respective modified forms of the roller support employed in the rocker arm shown in FIG. 1.
Figure 2C:
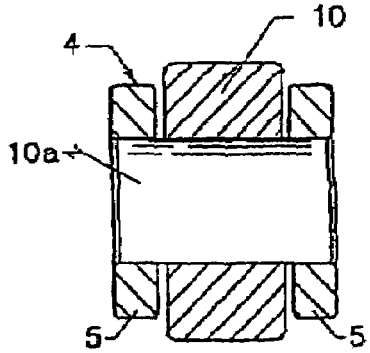

The roller 10 is of, for example, a double roller structure as best shown in FIG. 2A made up of an inner roller element 10A and an outer roller element 10B, wherein a contact area between an inner peripheral surface of the inner roller element 10A and the support pin 10*a* and a slide contact area between an outer peripheral surface of the inner roller element 10A and an inner peripheral surface of the outer roller 10B defines a respective plain bearing surface. Other than this, the roller 10 of the structure described above may be an outer race of a rolling bearing member as shown in FIG. 2B. In the example shown in FIG. 2B, a plurality of rolling elements 10*b* are interposed between the inner peripheral surface of the roller 10 and the support pin 10*a* to thereby allow the assembly to form the rolling bearing member. While the roller 10 shown in FIG. 2A is of the double roller structure and the roller 10 shown in FIG. 2B is constructed of a part of the rolling bearing member, it may be of a single roller type as shown in FIG. 2C where a sliding contact is desired to be employed.

Figure 3:
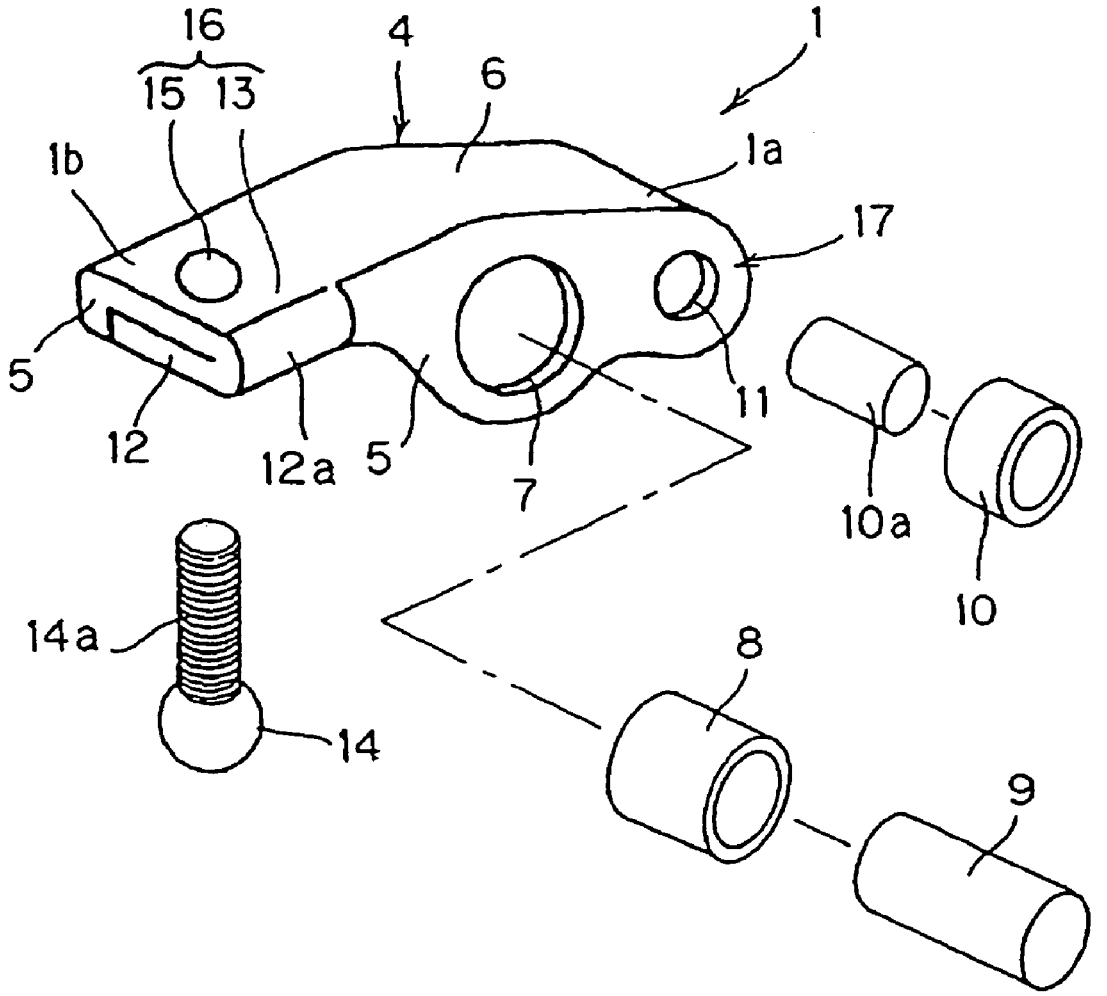
FIG. 3 is an exploded view of the rocker arm shown in FIG. 1, shown together with associated component parts.

Also, as shown in FIG. 3, the front end 1*b* of the connecting wall 6 has an end overlap piece 12 integrally extending therefrom, which overlap piece 12 is turned backwardly to define an overlapped structure 13. This overlapped structure 13 defines an adjustment element 16 formed with a mounting hole 15 defined therein so as to extend completely therethrough for adjustably receiving a valve driving member 14. The valve driving member 14 has a male-threaded screw shank 14*a*, while the mounting hole 15 in the adjustment element 16 is formed as a female-threaded screw hole for threadingly receiving the valve driving member 14. The end overlap piece 12 integrally extends from one side edge of the front end of the connecting wall 6 and is bent at the side edge thereof to define a bent base end 12*a*. A front end of the end overlap piece 12 is brought into contact with, or held in the vicinity of an inner surface of one of the side walls 5 remote from the bent base end 12*a*.

Material for the arm body 4 that can be employed in the practice of the present invention may be a case hardened steel (for example, SCM 415) that is tempered after having been carburized. The effective depth of a hardened layer thereof may be, for example, within the range of 0.4 to 1.5 mm and preferably within the range of 0.9 to 1.5 mm. It is to be noted that the material for the arm body and the numerical limitation of the effective depth of the hardened layer, both discussed above, can be equally applied to any one of the embodiments of the present invention which will be subsequently described.

With the rocker arm 1 of the structure described above, since the adjustment element 16 is defined by the overlapped structure 13 formed by overlapping the end overlap piece 12 against the connecting wall 6, a sufficient depth can be secured in the mounting hole 15 so formed as to extend completely through the adjustment element 16 and a sufficient strength can also be obtained around the mounting hole 15 in the adjustment element 16. In such case, since that portion which eventually forms the end overlap piece 12 is defined and subsequently bent so as to form the overlapped structure, reinforcement can easily be obtained. Also, since the adjustment element 16 of the overlapped structure is defined by the end overlap piece 12 extending from that side edge of the connecting wall 6, the dimension of the margin required to avoid a deteriorated portion in the vicinity of the bent portion occurring in a direction widthwise of the arm body 4 can be secured in the widthwise direction of the arm body 4. Because of this, the overall length of the arm body 4 will not increase to provide the overlapped structure. With respect to the direction widthwise of the arm body 4, because of securement of the widthwise dimension of the roller 10 held in rolling contact with the cam 2, a sufficient margin can be obtained relative to the inner diameter of the mounting hole 15 and, therefore, there is no need to increase the width of the arm body 4.

Figure 30:
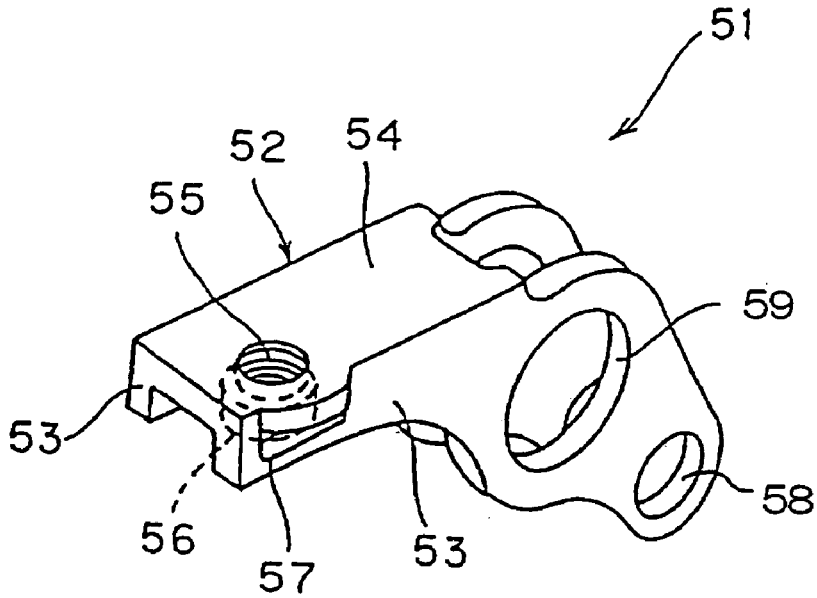
Fig. 30 PRIOR ART
FIG. 30 is a perspective view of one of the conventional rocker arms.
Figure 31:
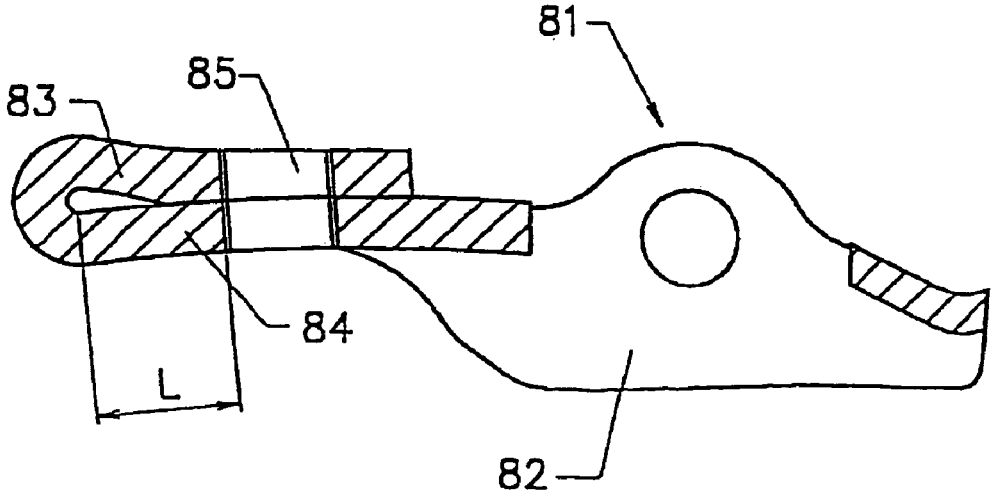
Fig. 31 PRIOR ART
FIG. 31 is a front elevational view of another one of the conventional rocker arm.
Figure 32:
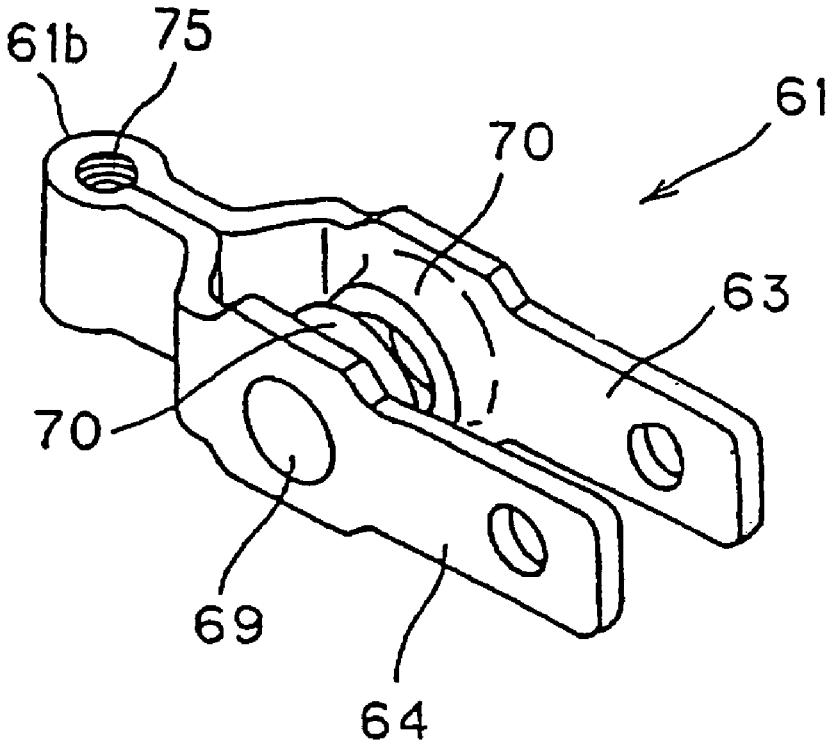
Fig. 32 PRIOR ART
FIG. 32 is a perspective view of still another one of the third conventional rocker arms.

The mounting hole 15 may be defined at a point either intermediate of the widthwise direction of the connecting wall 6 or displaced from the point intermediate of the width of the connecting wall 6. As a result of this displaced location, it is possible to offset the center of the adjustment element 16 and the center of the roller support structure 17 from each other in a direction of a rocking center axis of the rocker arm 1. Where this offset structure is employed, since no accessory portion such as the conventionally employed cylindrical bulged portions 56 (See FIG. 30) is employed around the mounting hole 15, an amount of offset can easily be secured. Also, since this rocker arm 1 is prepared from a single plate material by the use of the press work, it is light-weight and less costly with the number of processing steps minimized.

A surface of the end overlap piece 12 of the adjustment element 16 and a surface of the connecting wall 6 held in contact with that surface of the end overlap piece 12 may be firmly interlocked with each other by means of a welding technique. By this interlock, the strength of the adjustment element 16 can be advantageously increased.

Figure 4A:
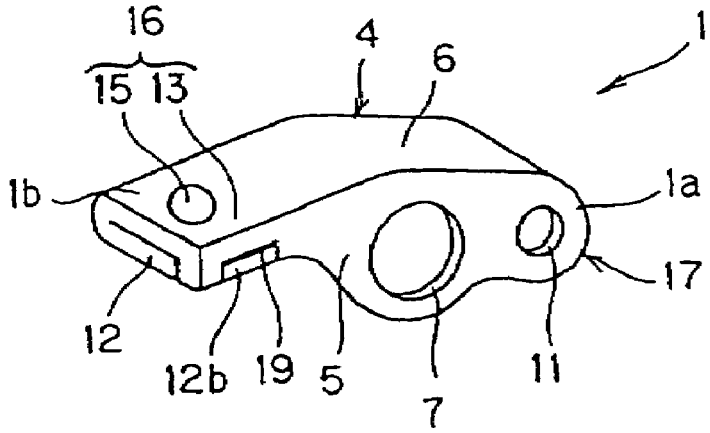
FIGS. 4A to 4C are perspective views showing second to fourth preferred embodiments of the rocker arm according to the first aspect of the present invention, respectively.

As shown in FIG. 4A, the end overlap piece 12 may have its front end 12*b* engaged in an engagement opening 19 that is defined in one of the side walls 5. This engagement opening 19 is defined in the form of a groove in a lower edge of the front end 1*b* of such one of the side walls 5. When the end overlap piece 12 is designed to assume a confined or mated structure, the strength of the adjustment element 16 can be advantageously increased. It is to be noted that the confined structure and the interlock by the use of a welding technique may be employed concurrently.

Figure 4B:
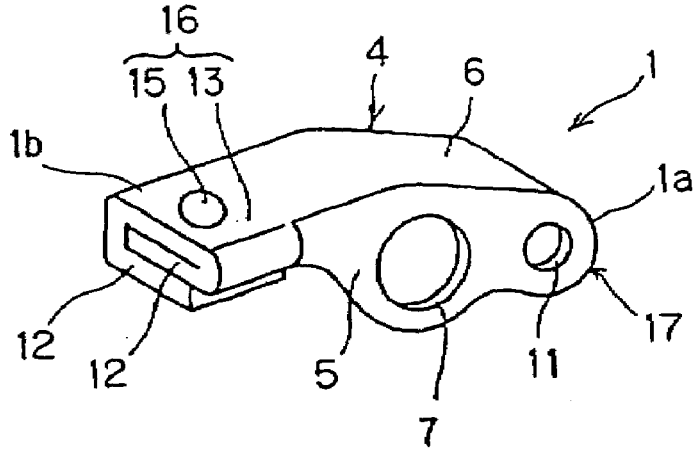
Figure 4C:
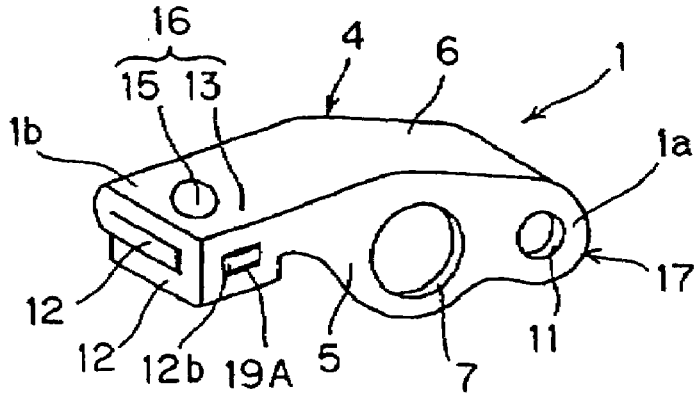

Also, as shown in FIG. 4B, a plurality of end overlap pieces 12 may be employed and folded one inside the other to define the overlapped structure 13 in the form of a triple overlapped structure. So far shown in FIG. 4B, the end overlap pieces 12 integrally extend from opposite side edges of the connecting wall 6, respectively, and are then folded one inside the other. Thus, where the overlapped structure 13 is designed to be a triple overlapped structure, the thickness of the adjustment element 16 increases further and the mounting hole 15 can have an increased depth and, therefore, the strength of the adjustment element 16 can further be increased. The end overlap piece 12 may additionally extend from the front end 1*b* of the connecting wall 6 in a direction towards the front end and may subsequently be bent to thereby render the overlapped structure 14 to be a quadruple overlapped structure. Where the overlapped structure 13 is formed as more than triple overlapped structure, plate elements, each forming one layer of the overlapped structure 13, may be firmly connected at their mutually confronting surfaces with each other by the use of a welding technique.

Where the overlapped structure 13 is employed in the form of the triple overlapped structure, as shown in FIG. 4C, an intermediate end overlap piece 12 may be engaged in an engagement opening 19A defined in one of the side walls 5. In such case, the engagement opening 19A will be in the form of an aperture.

Figure 5A:
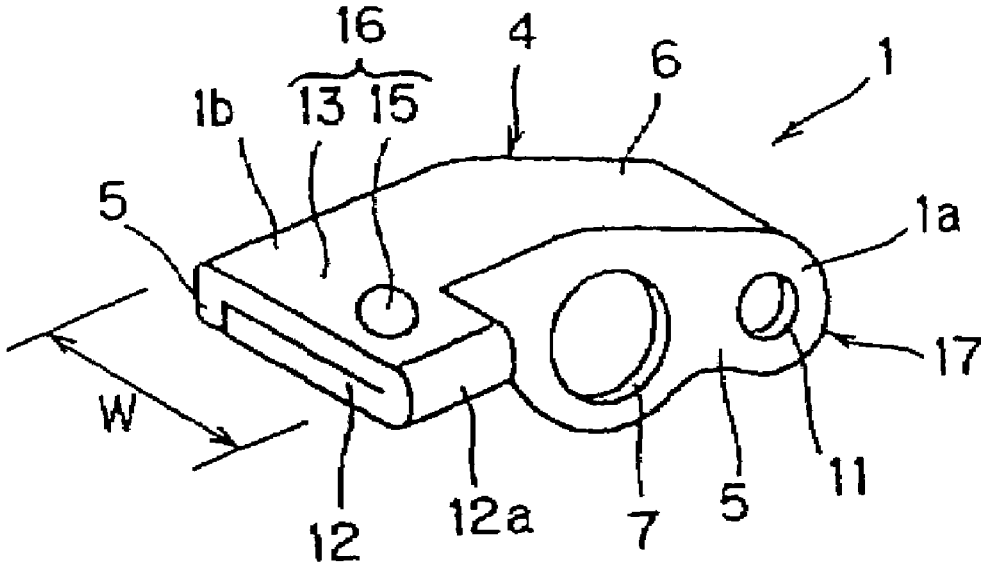
FIGS. 5A and 5B are perspective views showing fifth and sixth preferred embodiments of the rocker arm according to the first aspect of the present invention, respectively.

In the embodiment shown in FIGS. 1 and 2, the overlapped structure 13 may extend in one lateral direction from the connecting wall 6 to thereby render the width W of the overlapped structure 13 in the widthwise direction of the connecting wall 6 to be large as shown in FIG. 5A. In such case, the mounting hole 15 is displaced in a direction in which the overlapped structure 13 is extended.

As such, by increasing the width W of the overlapped structure 13 that defines the adjustment element 16, without changing the widthwise dimension of a main portion of the arm body 4, the amount of offset between the adjustment element 16 and the roller support structure 17 can be indefinitely fixed. Accordingly, the relatively large amount of offset can be obtained without incurring a considerably increase of the weight of the rocker arm 1.

Figure 5B:
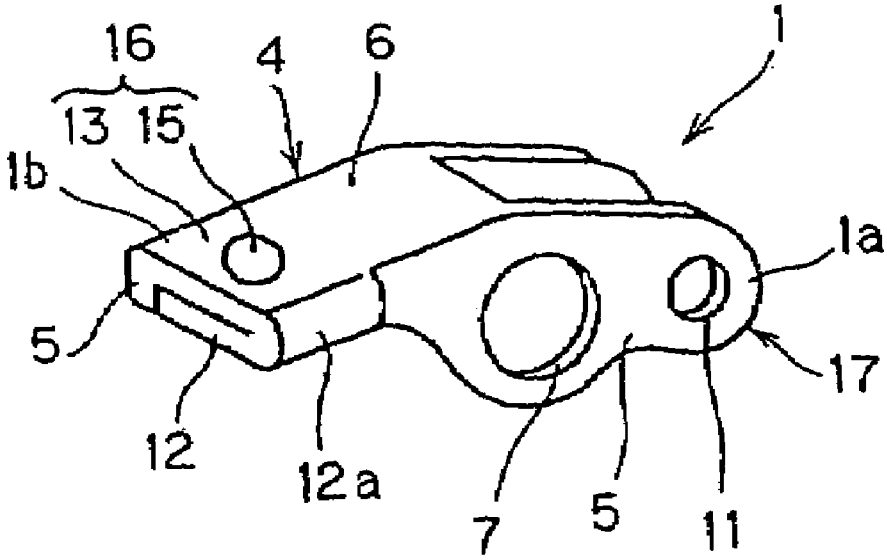

Also, in the embodiment shown in FIGS. 1 and 2, the connecting wall 6 of the rocker arm 1 can be formed in any desired shape so far as the roller 10 does not interfere and, for example, as shown in FIG. 5B, the connecting wall 6 may be so configured and so disposed as to extend from a point generally intermediate of the lengthwise direction of the arm body 4 to the adjustment element 16. If the range in which the connecting wall 6 is formed is reduced as described with reference to FIG. 5B, the light-weight feature can be obtained. However, if the range in which the connecting wall 6 is formed is reduced, the strength will decrease and, therefore, it must be limited to the range for which the required strength can be assured.

Any one of the examples shown in FIGS. 6A to 6D and FIGS. 7A to 7D is featured in that in the first embodiment shown in FIGS. 1 and 2, both or either one of the side walls 5 is rendered to be of an overlapped structure.

Specifically, in the example shown in FIG. 6A, each of the side walls 5 is formed with a side overlap piece 21 integrally extending therefrom, which side overlap piece 21 is subsequently bent so as to assume an overlapping relation with the respective side wall 5 to thereby render the side wall 5 to represent an overlapped structure. The side overlap piece 21 is of a size sufficient to overlap an area adjacent the pivot support hole 7 and extends integrally from the respective side wall 5 in a direction downwardly therefrom and is then bent outwardly and upwardly so as to overlap an outer surface of the respective side wall 5. Also, this overlapped structure defined by the side overlap piece 21 is provided on each of the opposite side walls 5.

Figure 6A:
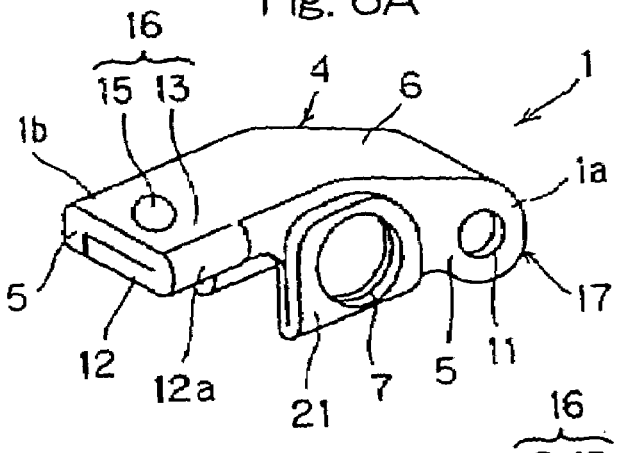
FIGS. 6A to 6D are perspective views showing seventh to tenth preferred embodiments of the rocker arm according to the first aspect of the present invention, respectively.
Figure 6B:
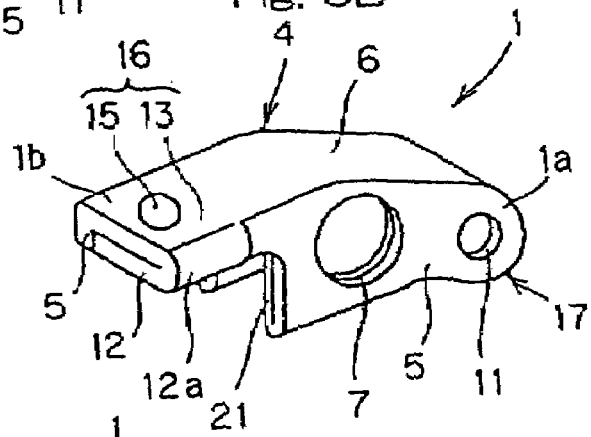

On the other hand, the example shown in FIG. 6B is such that in the example shown in FIG. 6A, in place of the side overlap piece 21 being bent so as to overlap the outer surface of the respective side wall 5, it is bent so as to overlap an inner surface of the respective side wall 5.

Figure 6C:
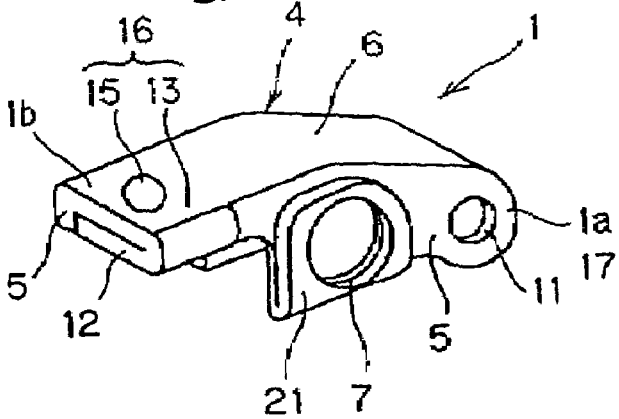
Figure 6D:
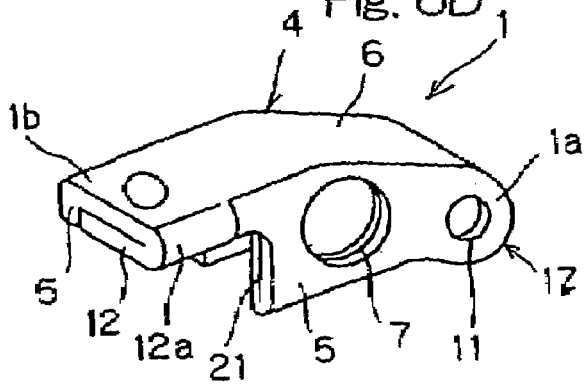

Each of the examples shown in FIGS. 6C and 6D is such that in each of the examples shown respectively in FIGS. 6A and 6B, in place of the opposite side walls 5 being so configured as to represent the overlapped structure, only one of the side walls 5 is configured to represent the overlapped structure.

The example shown in FIG. 7 is such that in the embodiment in which the overlapped structure 13 of the adjustment element 16 is so shaped as to extend in one lateral direction from the connecting wall 6 and the width of the overlapped structure 13 as measured in the widthwise direction of the connecting wall 6 is made larger than the connecting wall 6 such as shown in the example of FIG. 5A, the side overlap piece 21 is employed as is the case with the example of FIG. 6A to thereby render the side wall 5 to represent a double walled structure.

Figure 7A:
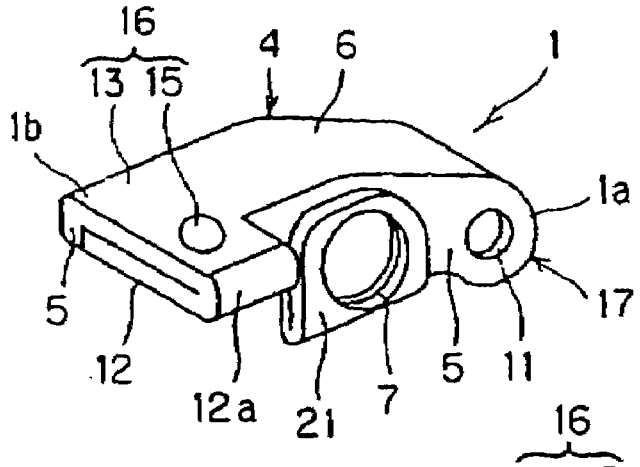
FIGS. 7A to 7D are perspective views showing eleventh to fourteenth preferred embodiments of the rocker arm according to the first aspect of the present invention.
Figure 7B:
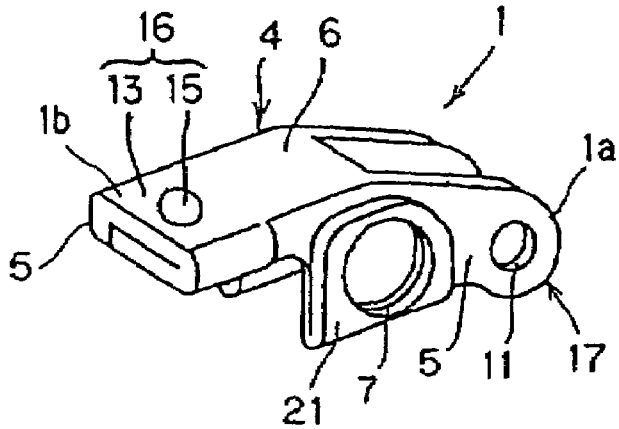

The example shown in FIG. 7B is such that in the embodiment in which, as is the case with the example of FIG. 5B, the connecting wall 6 extends from the point generally intermediate of the lengthwise direction of the arm body 4 to the adjustment element 16, the side overlap piece 21 is employed as is the case with the example shown in FIG. 6A to thereby render the side wall 5 to represent the double walled structure.

Figure 7C:
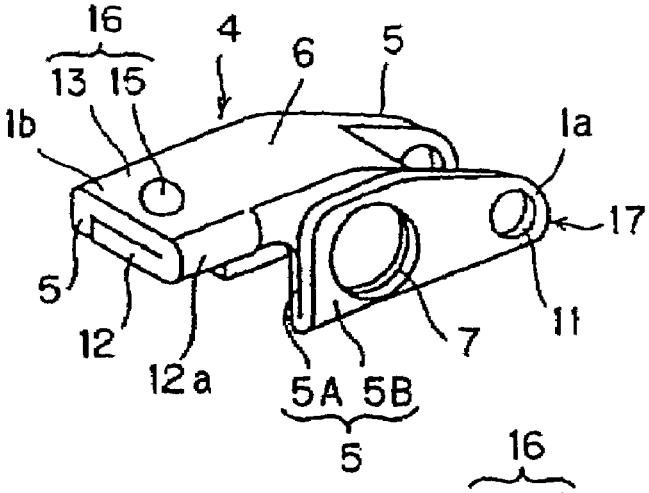

The example shown in FIG. 7C is such that in the embodiment in which as is the case with the example shown in FIG. 7B, the connecting wall 6 extends from the point generally intermediate of the lengthwise direction of the arm body 4 to the adjustment element 16, each of the side walls 5 of the overlapped structure is defined by a first side wall forming plate segment 5A continued from the connecting wall 6 and forming a portion around the pivot support hole 7, and a second side wall forming plate segment 5B. The second side wall forming plate segment 5B extends integrally from the first side wall forming plate segment 5A and is then bent to overlap the first side wall forming plate segment 5A with its free end formed with the roller support hole 11.

Figure 7D:
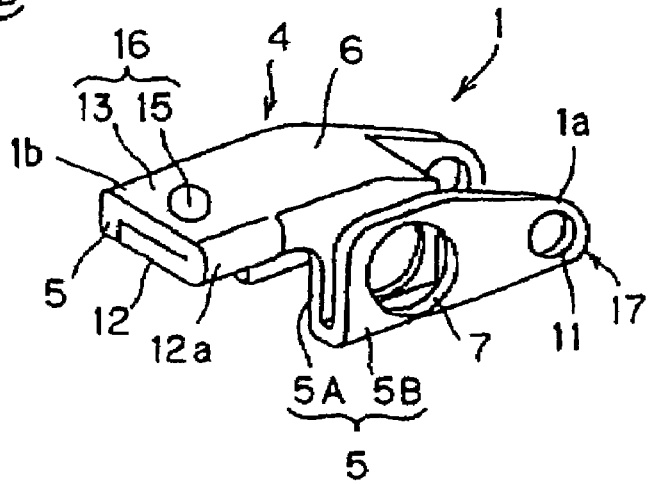

The example shown in FIG. 7D is such that in the example shown in FIG. 7C the first side wall forming plate segment 5A and the second side wall forming plate segment 5B are separated in a direction of the axis of the pivot support pin so that the center of the adjustment element 16 and the center of the roller support structure 17 are displaced in the direction of the axis of the pivot support pin to represent an offset structure.

Even in any of the examples shown in FIGS. 6A to 6D and FIGS. 7A to 7D, the side wall 5 represents the overlapped structure and, therefore, the strength of the side wall 5 can be increased.

Figure 8:
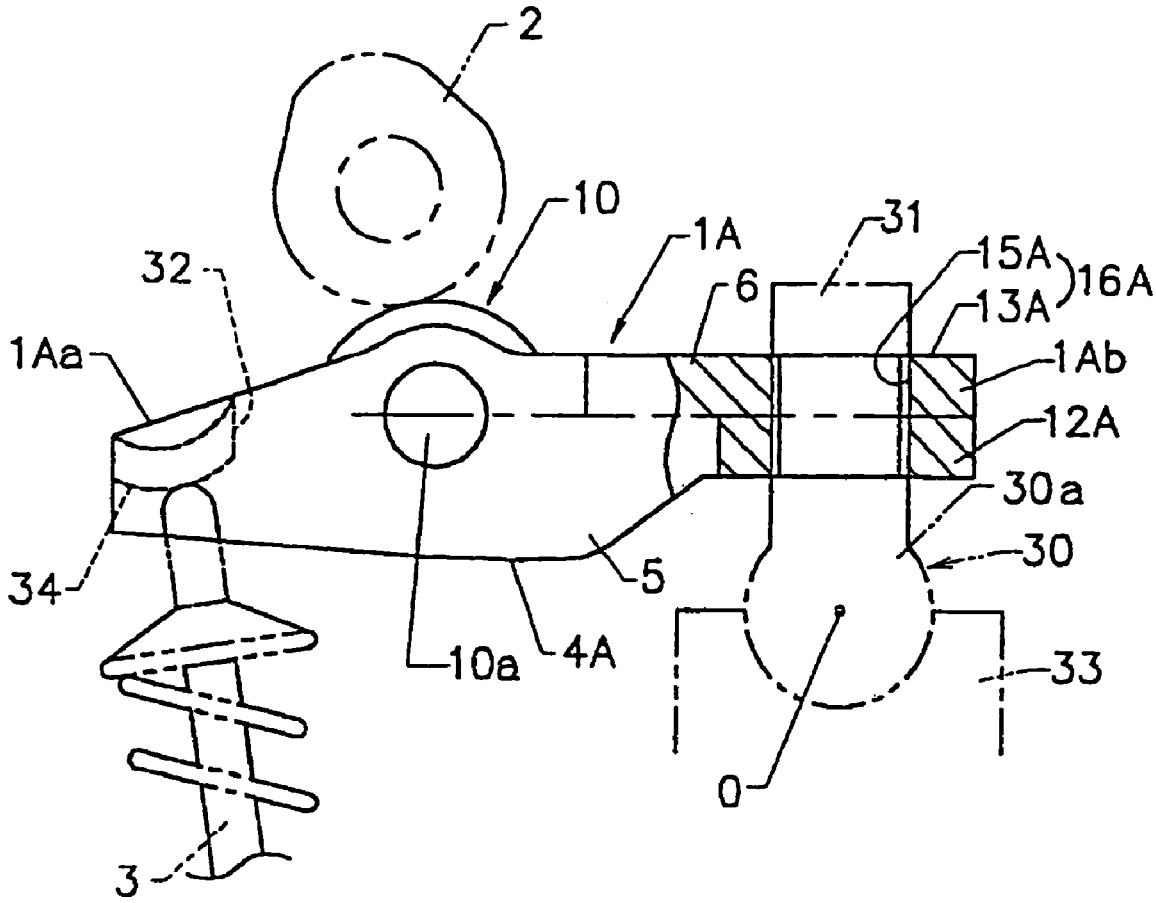
FIG. 8 is a front elevational view showing a first preferred embodiment of the rocker arm according to a second aspect of the present invention, shown together with a peripheral structure of an internal combustion engine.
Figure 9A:
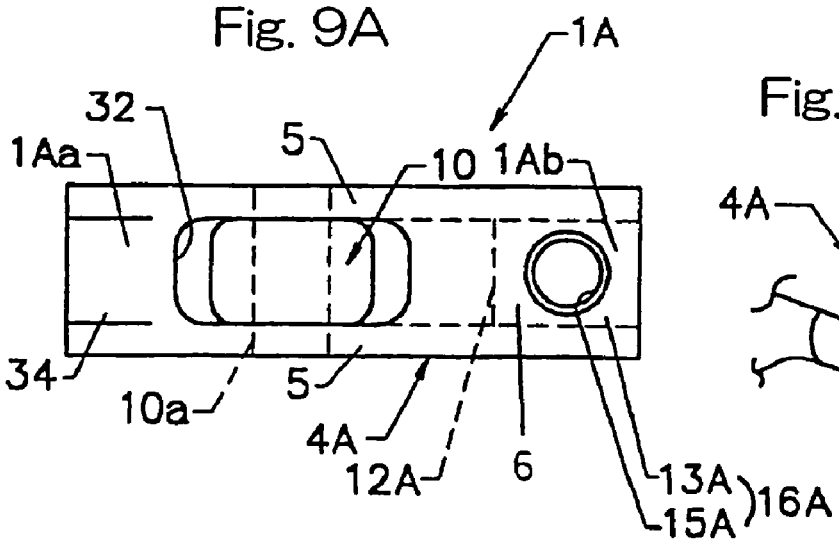
FIG. 9A is a plan view of the rocker arm shown in FIG. 8.
Figure 9B:
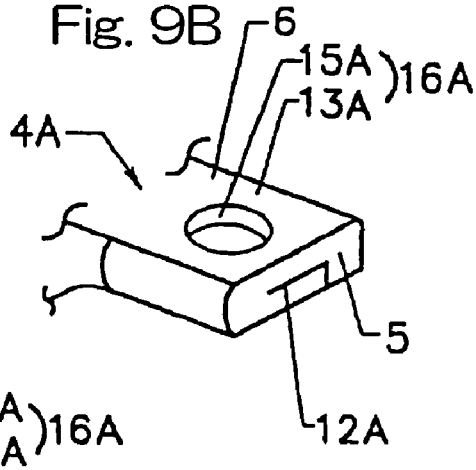
FIG. 9B is a perspective view showing a portion of the rocker arm shown in FIG. 8.

FIGS. 8 and 9 illustrate one preferred embodiment of the rocker arm according to a second aspect of the present invention (Second Embodiment). A rocker arm 1A shown therein is of an end pivot type utilized on an internal combustion engine for actuating the valve 3 of the cylinder head when driven by the cam 2 so as to undergo a rocking motion. Even in this rocker arm 1A, an arm body 4A is prepared from a single plate material by the use of a press work so as to assume a generally inverted U-shaped section defined by the opposite side walls 5 and the connecting wall 6 straddling between respective upper edges of the opposite side walls 5. The plate material referred to above is, for example, a steel plate which may be of the same material as in and is heat-treated in the same manner as that used in the first embodiment. The arm body 4A has a side profile which may be either substantially straight or be angled, but in the embodiment shown therein it represents a generally straight profile. The opposite side walls 5 are symmetrical with respect to each other except for a portion of a rear end 1Ab.

The arm body 4A has a roller 10 rollingly engageable with the cam 2, which is mounted on a portion intermediate of the arm body 4A in the lengthwise direction thereof, and is formed at a first or front end 1Aa thereof with a valve driving member 34 that acts on the valve 3 and also at the opposite second or rear end 1Ab defining the adjustment element 16A on which a pivot member 30 is fitted. The valve driving member 34 is constructed of a portion of the connecting wall 6 and is so curved as to protrude towards the valve 3 when viewed in section along the lengthwise direction of the arm body 4A. The connecting wall 6 of the arm body 4A is provided in a range of the generally overall length thereof in the lengthwise direction, excluding an intermediate portion thereof that is formed in a window 32 into which a portion of the roller 10 protrudes. A portion on the front end 1Aa adjacent the window 32 serves as the valve driving member 34. The roller 10 is of, for example, the double roller structure including the inner roller element 10A and the outer roller element 10B as is the case with that shown in FIG. 2A in connection with the first embodiment, wherein a contact area between the inner peripheral surface of the inner roller element 10A and the support pin 10*a* and a slide contact area between the outer peripheral surface of the inner roller element 10A and the inner peripheral surface of the outer roller 10B defines a respective plain bearing surface. Other than this, the roller 10 of the structure described above may be an outer race of a rolling bearing member as shown in FIG. 2B. In the example shown in FIG. 2B, a plurality of rolling elements 10*b* are interposed between the inner peripheral surface of the roller 10 and the support pin 10*a* to thereby allow the assembly to form the rolling bearing member. The roller 10 may be also of a single roller type.

Referring to FIGS. 8 and 9, an adjustment element 16A is in the form of an overlapped structure 13A formed by providing a portion of the connecting wall 6 at the rear end 1Ab of the arm body 4A with an end overlap piece 12A extending integrally from a side edge of the connecting wall 6 and then bending the end overlap piece 12A so as to overlap the connecting wall 6, and a mounting hole 15A in which the pivot member 30 is adjustably engaged is so formed as to extend through the overlapped structure 13A. A free end of the end overlap piece 12A is held in contact with or positioned adjacent an inner surface of one of the opposite side walls 5 opposite to a bent base end. The mounting hole 15A is in the form of an internally threaded screw hole. The pivot member 30 includes an externally threaded screw shank 31 and a generally spherical pivot element 30*a* formed with one end of the externally threaded screw shank 31 and is inserted into the mounting hole 15A with the externally threaded shank 31 engaged in the internally threaded mounting hole 15A in the adjustment element 16A. This pivot member 30 is rockingly supported with the pivot element 30*a* received in a pivot receiving element 33. The center of rocking of the pivot element 30*a*, that is, the center of the sphere of the pivot element 30*a* defines the center O about which the arm body 4A undergoes a rocking motion. Other structural features of the rocker arm 1A in this embodiment are substantially similar to those shown and described in connection with the rocker arm according to the first embodiment.

According to the previously described embodiment shown in FIGS. 8 and 9, although the embodiment shown in FIGS. 8 and 9 differs from the first embodiment in that in the embodiment shown in FIGS. 8 and 9 a member fitted to the adjustment element 16A is defined by the pivot member 30, the following effects similar to those afforded by the first embodiment can be obtained. Specifically, since in the rocker arm 1A according to the embodiment shown in FIGS. 8 and 9 the adjustment element 16A is defined by the overlapped structure 13A in which the end overlap piece 12A is bent to overlap the connecting wall 6, a sufficient depth can be secured in the mounting hole 15A extending through this adjustment element 16A and a sufficient strength of the adjustment element 16A around the mounting hole 15A can also be secured. In such case, since the adjustment element 16A can be formed merely by providing that portion defining the end overlap piece 12A and then bending it to overlap the connecting wall 6, reinforcement can easily be accomplished. Also, since the adjustment element 16A of the overlapped structure is defined by the end overlap piece 12A extending from the side edge of the connecting wall 6, the dimension of the margin required to avoid a deteriorated portion in the vicinity of the bent portion occurring in a direction widthwise of the arm body 4 can be secured in the widthwise direction of the arm body 4A. Because of this, the overall length of the arm body 4 will not increase to provide the overlapped structure. With respect to the direction widthwise of the arm body 4A, a sufficient margin can be obtained relative to the inner diameter of the mounting hole 15A so that the widthwise dimension of the roller 10 held in rolling contact with the cam 2 needs secured and, therefore, there is no need to increase the width of the arm body 4A. It is to be noted that the overlapped structure 13A may take any of the modifications shown respectively in FIGS. 4A to 4C, 5A and 5B, as is the case with that employed in the previously described first embodiment.

Figure 10:
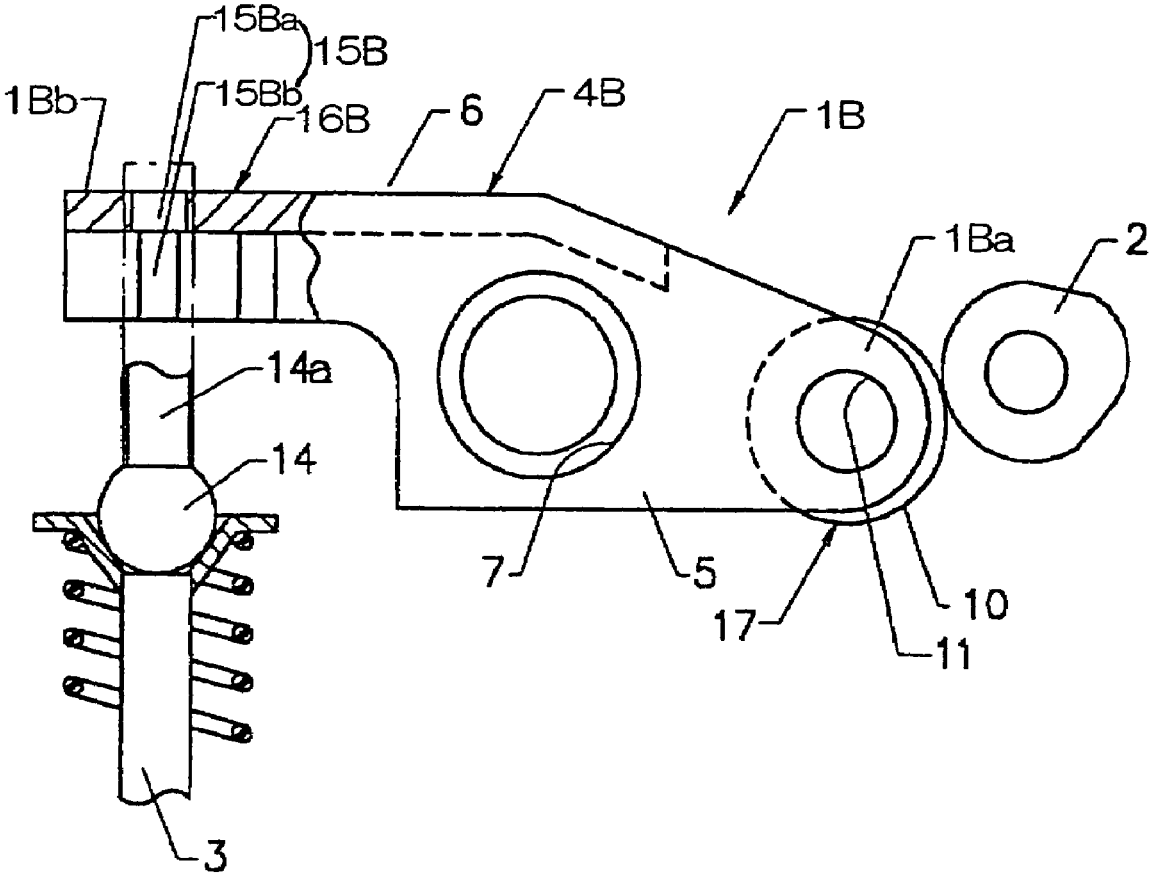
FIG. 10 is a front elevational view showing a first preferred embodiment of the rocker arm according to a third aspect of the present invention, shown together with a peripheral structure of an internal combustion engine.
Figure 11:
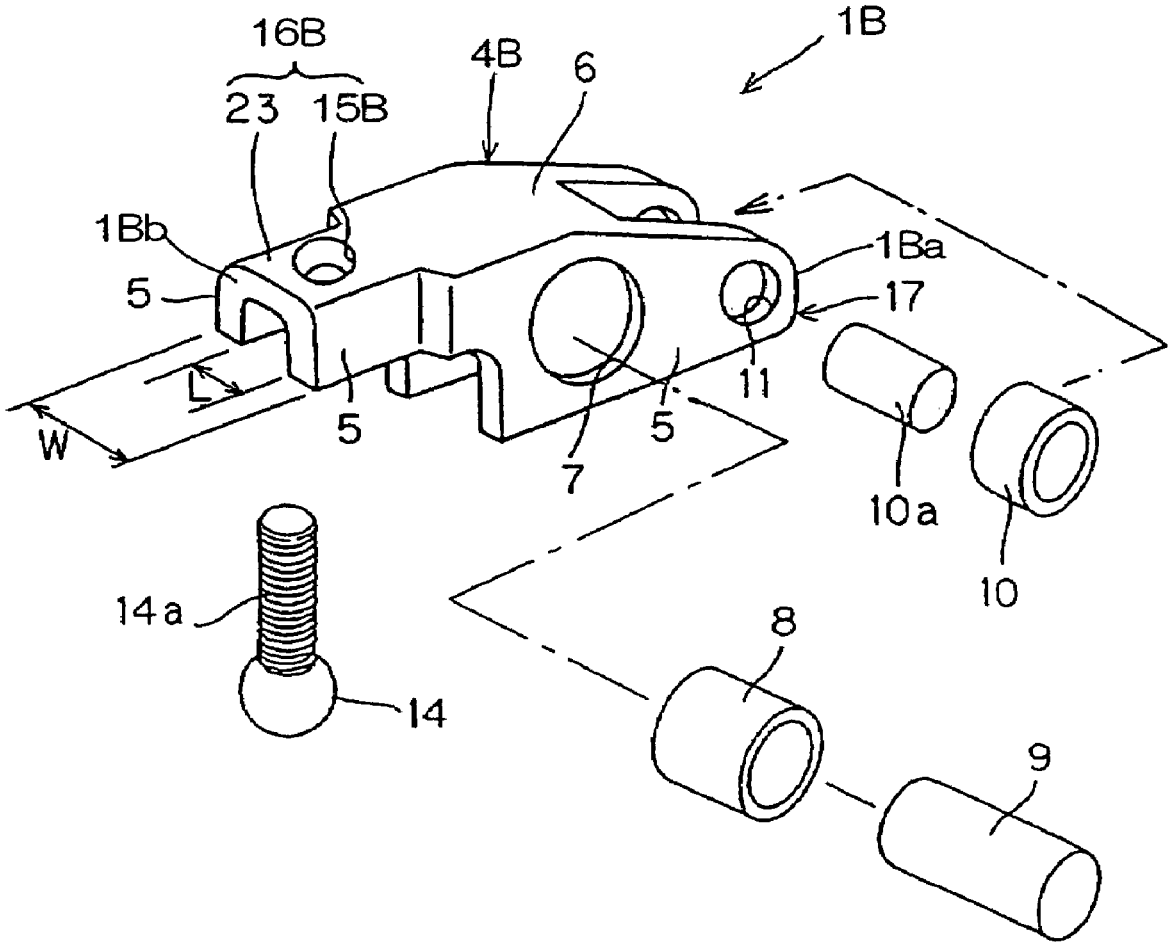
FIG. 11 is an exploded view of the rocker arm shown in FIG. 10, shown together with associated component parts.

A preferred embodiment of the rocker arm according to a third aspect of the present invention (Third Embodiment) will now be described with reference to FIGS. 10, 11 and 12A to 12C. As best shown in FIG. 10, a rocker arm 1B shown therein is of an center pivot type utilized on an internal combustion engine for opening and closing the valve 3 of the cylinder head by means of a front end 1Bb thereof when a rear end 1Ba thereof is driven by the cam 2 so as to undergo a rocking motion. As shown in FIG. 11, the rocker arm 1B includes an arm body 4B that is prepared from a single plate material by the use of a press work so as to assume a generally inverted U-shaped section defined by the opposite side walls 5 and the connecting wall 6 straddling between respective upper edges of the opposite side walls 5. The plate material referred to above is, for example, a steel plate which may be of the same material as in and is heat-treated in the same manner as that used in the first embodiment. The arm body 4B has a side profile which may be either substantially straight or be angled, but in the embodiment shown therein it represents a generally straight profile. The opposite side walls 5 are symmetrical with respect to each other. The connecting wall 6 is so formed as to extend from a portion generally intermediate of the lengthwise direction of the arm body 4B to the front end 1Bb of the arm body 4B. The range in which the connecting wall 6 of the rocker arm 1B is formed with respect to the lengthwise direction of the arm body 4B may be arbitrarily chosen as desired so long as it extends to the front end 1Bb without being interfered with the roller 10.

The arm body 4B has the pivot support hole 7 defined at a portion intermediate of the lengthwise direction of the arm body 4B for defining a fulcrum about which the rocker arm 1B undergoes a rocking motion. This arm body 4B has the rear end 1Ba provided with the roller 10 for engagement with the cam 2 and the front end 1Bb formed with an adjustment element 16B having an internal thread 15B that is meshable with a male thread 14*a* of the valve driving member 14 when the latter is threadingly inserted into the adjustment element 16B. The pivot support hole 7 is defined in each of the opposite side walls 5. The pivot support pin 9 is engaged in the pivot support holes 7 through respective bushings 8. The rocker arm 1B is supported for rocking motion about the pivot support pin 9 in respective directions opposite to each other. The bushings 8 are, for example, press-fitted into the respective pivot support holes 7. Respective end portions of the side walls 5 adjacent the rear end 1Ba of the cam body 4B are formed with the roller support holes 11 for supporting the support pin 10*a* with opposite ends of the latter engaged in the support holes 11, and the roller 10 is rotatably mounted on the support pin 10*a* for engagement with the cam 2 (FIG. 10). Those end portions of the side walls 5 adjacent the rear end 1Ba of the cam body 4B and the support pin 10*a* journalled thereby altogether constitute the roller support structure 17.

It is to be noted that the roller 10 employed in this embodiment is of the structure shown in any one of FIGS. 2A to 2C, reference to which has been made in connection with the first embodiment.

Figure 12A:
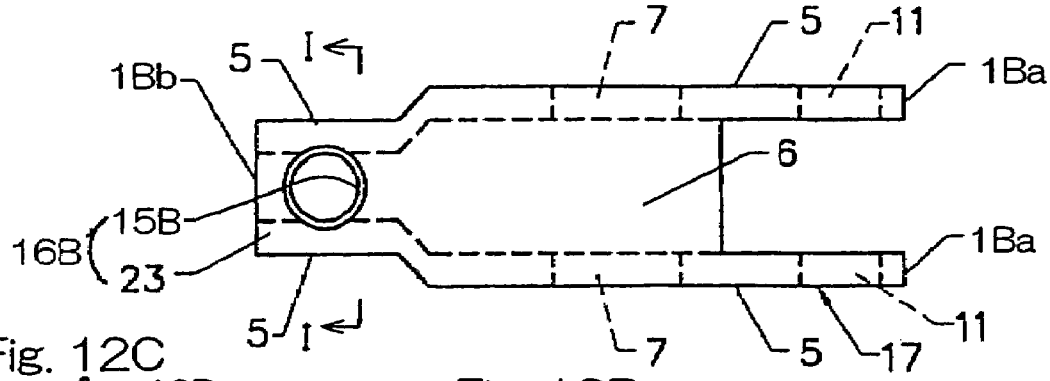
FIG. 12A is a plan view of the rocker arm shown in FIG. 10.
Figure 12C:
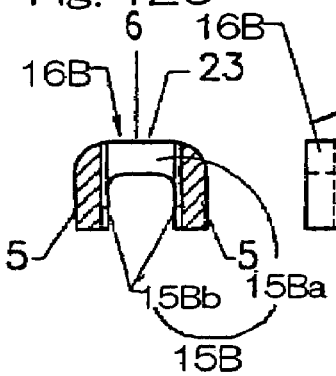
FIG. 12C is a transverse sectional view of the rocker arm shown in FIG. 10.
Figure 12B:
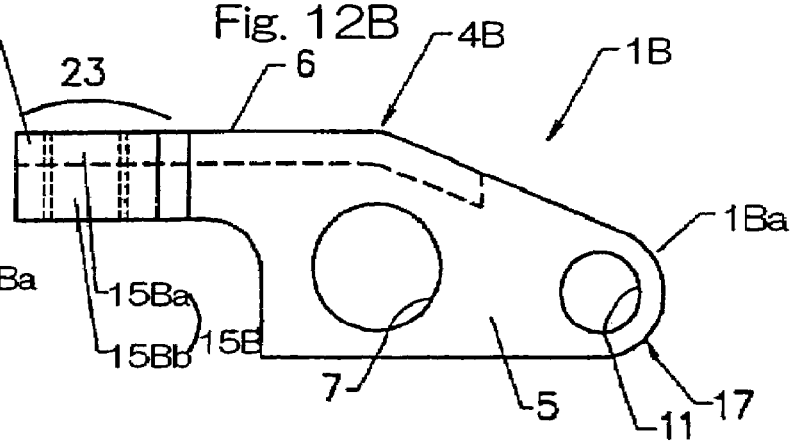
FIG. 12B is a front elevational view of the rocker arm shown in FIG. 10.
Figure 13:
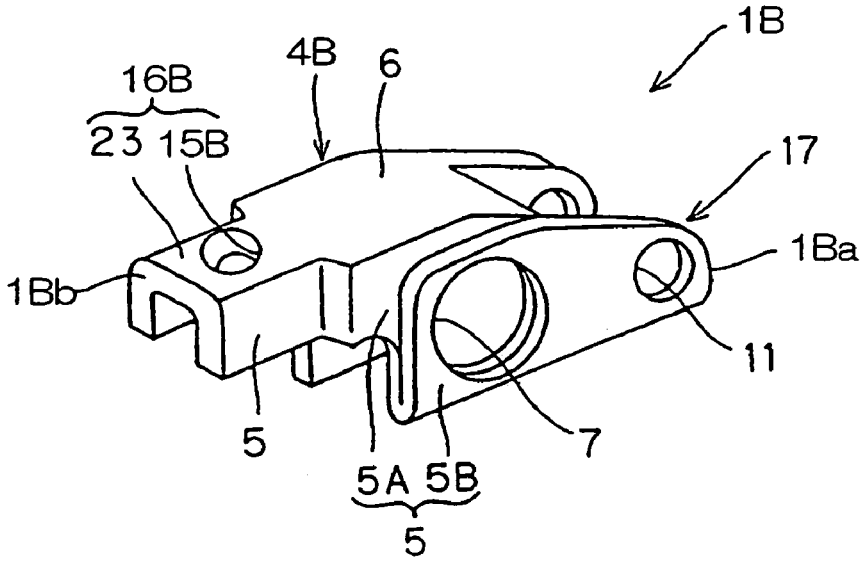
FIG. 13 is a perspective view of an arm body showing a second preferred embodiment of the rocker arm according to the third aspect of the present invention.
Figure 14A:
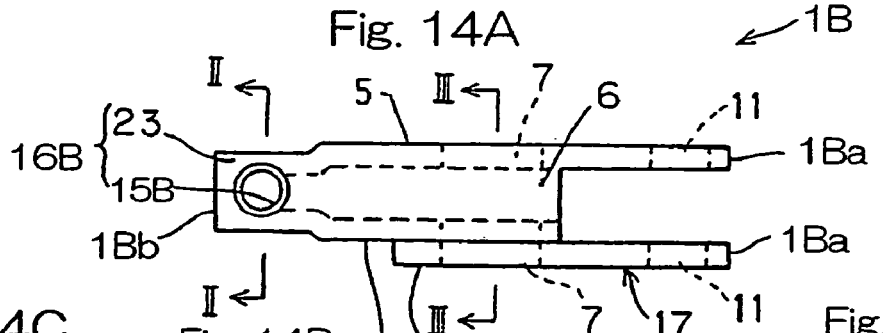
FIG. 14A is a plan view of the arm body shown in FIG. 13.
Figure 14C:
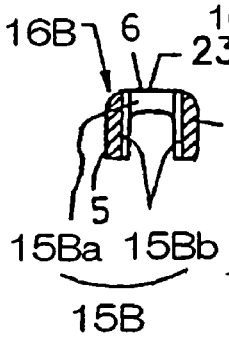
FIG. 14C is a cross-sectional view taken along the line II—II in FIG. 14A.
Figure 14B:
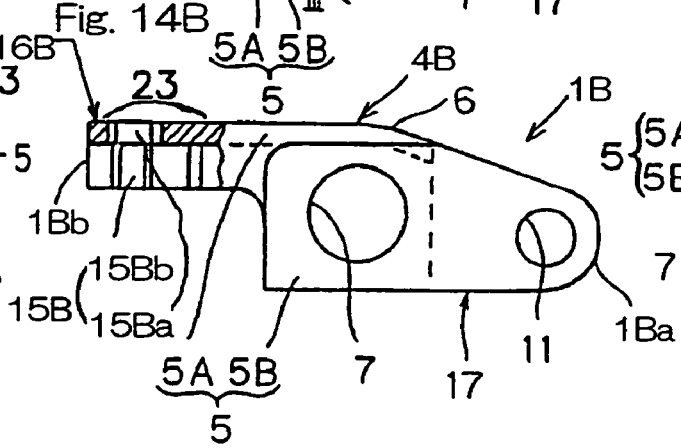
FIG. 14B is a side view of the arm body shown in FIG. 13.
Figure 14D:
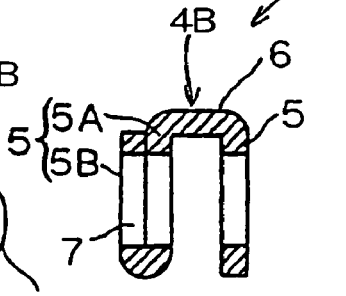
FIG. 14D is a cross-sectional view taken along the line III—III in FIG. 14A.
Figure 15A:
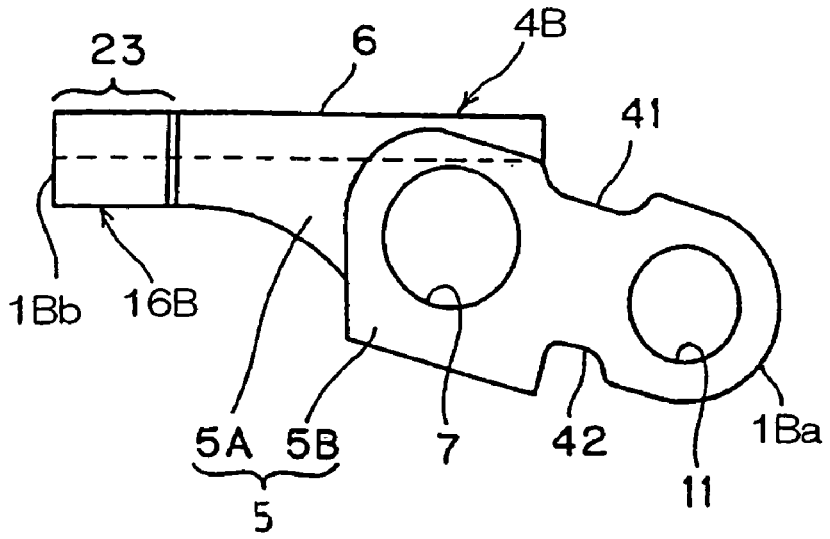
FIG. 15A is a front elevational view of the arm body showing a third preferred embodiment of the rocker arm according to the third aspect of the present invention.
Figure 15B:
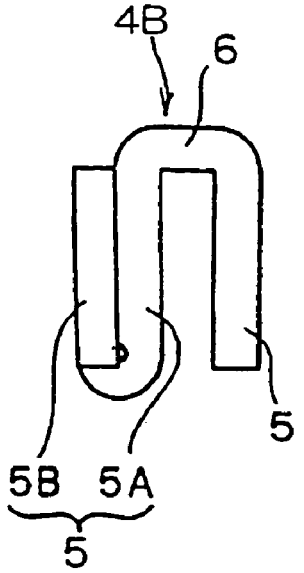
FIG. 15B is a sectional view of the arm body shown in FIG. 15A, when viewed from the right side.
Figure 15C:
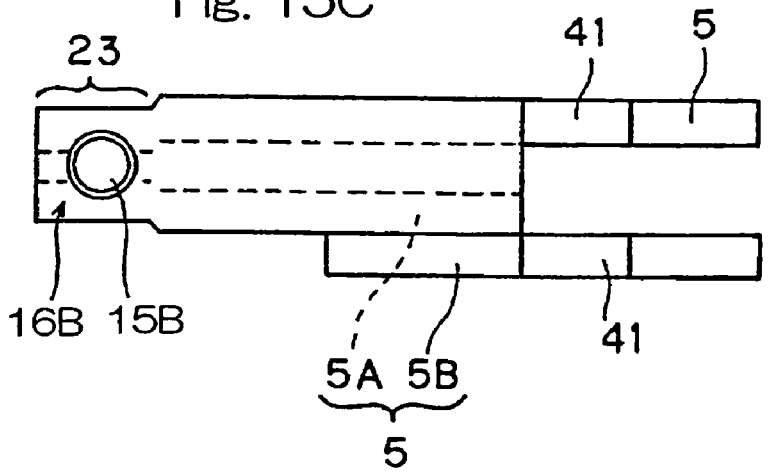
FIG. 15C is a plan view of the arm body shown in FIG. 15A.
Figure 15D:
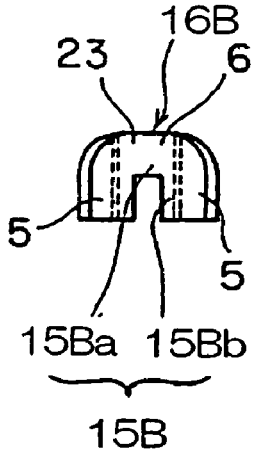
FIG. 15D is a sectional view of the arm body shown in FIG. 15A, when viewed from the left side.
Figure 15E:
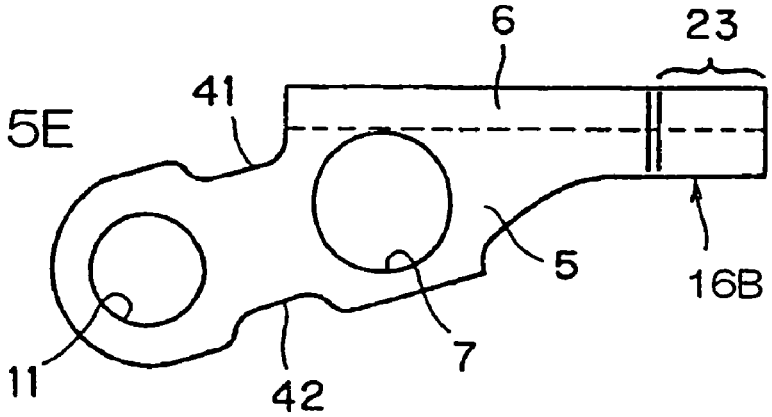
FIG. 15E is a rear view of the arm body shown in FIG. 15A.
Figure 16:
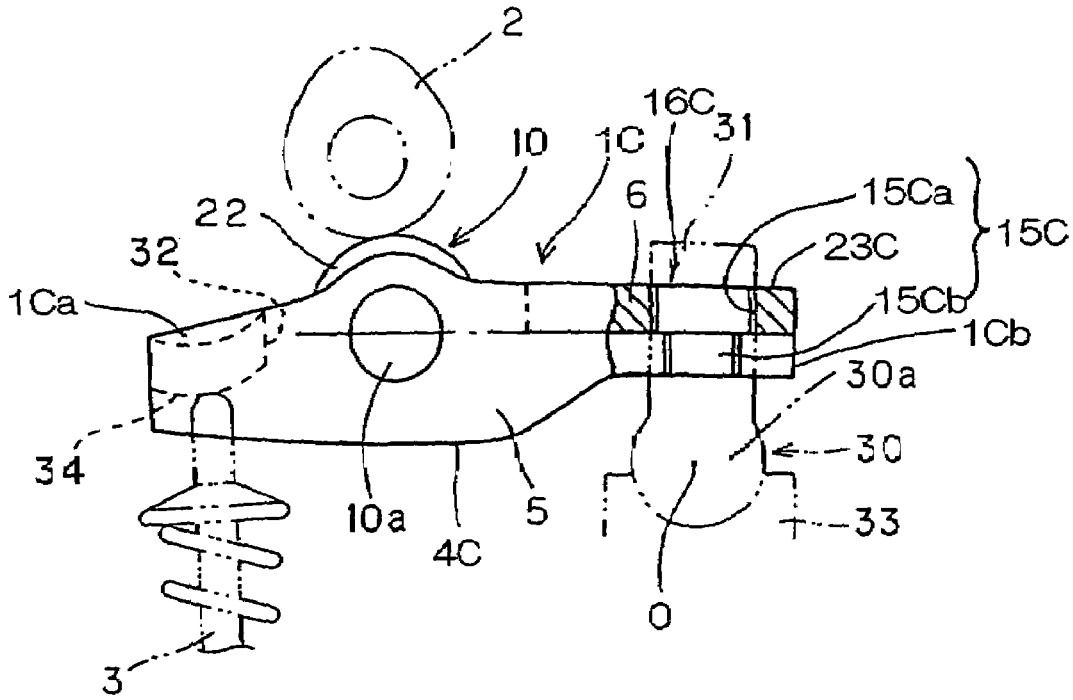
FIG. 16 is a front elevational view showing a first preferred embodiment of the rocker arm according to a fourth aspect of the present invention.
Figure 17:
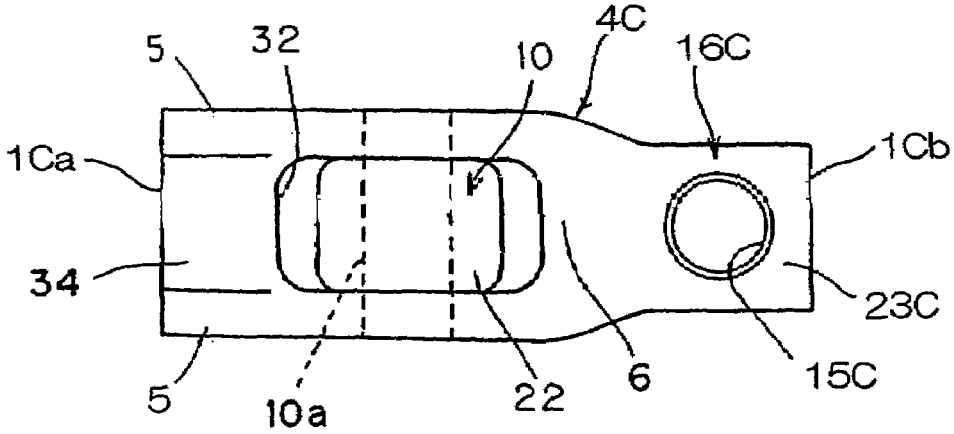
FIG. 17 is a plan view of the rocker arm shown in FIG. 16.

As shown in FIG. 11, the adjustment element 16B is represented by a reduced width portion 23 of a generally inverted U-shaped section in which the width thereof is smaller than that of the intermediate portion of the connecting wall 6 and the distance L between the opposite side walls 5 is smaller than the inner diameter of the female thread 15B. As shown in FIG. 12C showing a cross-section taken along the line I—I in FIG. 12A, the female thread 15B is made up of a internally threaded hole 15Ba extending through the reduced width portion 23 of the connecting wall 6, and partially threaded portions 15Bb formed respectively in the mutually confronting surfaces of the opposite side walls 5 in continuation with the internally threaded hole 15Ba. It is to be noted that although in the illustrated embodiment the reduced width portion 23 is so designed as to allow the center thereof in a widthwise direction to be aligned with the center of the arm body 4B in the widthwise direction, the center of the reduced width portion 23 in the widthwise direction may be displaced in one lateral direction relative to the center of the arm body 4B in the widthwise direction. It is also to be noted that the reduced width portion 23 suffices if the distance L (FIG. 11) is smaller than the diameter of the female thread 15 and the width of the reduced width portion 23 may be equal to or greater than that of the intermediate portion of the connecting wall 6.

With the rocker arm 1B of the above described structure, since the adjustment element 16B is defined by the reduced width portion 23 of the generally inverted U-shaped section, a necessary strength can be secured and, since the generally inverted U-shaped section is similar to that assumed by the arm body 4B, processing is easy to achieve. The female thread 15B in which the valve driving member 14 is fitted is made up of the internally threaded hole 15Ba formed in the connecting wall 6 forming a ceiling of the adjustment element 16B and the partially threaded portions 15Bb formed respectively in the mutually confronting surfaces of the opposite side walls 5 in continuation with the internally threaded hole 15Ba and, accordingly, a male thread 14*a* of the valve driving member 14 can be threadingly engaged with the opposite side walls 5. Because of this, a threading strength of the female thread 15B for receiving the valve driving member 14 can be secured. Hence, no use of, for example, any overlapped structure or wall of an increased thickness is needed for reinforcement of the screw hole. Where, however, the overlapped structure is employed, a bending step will be necessitated with consequent increase of the number of manufacturing steps, but where the reduced width portion of the inverted U-shaped profile is employed as hereinabove described, it is possible to mold such reduced width portion simultaneously with formation of the arm body 4B and, also, even though a drawing step is subsequently performed, a simple manufacturing process is sufficient. Also, where the inverted U-shaped profile with reduced width is employed, there is no complexity in process and there is no possibility of cracking occurring at the bent base end. As such, by utilizing the opposite side walls 5 for threading engagement, both increase in strength and increase in processability can be obtained. In addition, since the rocker arm 1B in this embodiment is prepared from a single plate material by the use of any known press work, it is indeed light-weight with the number of the manufacturing steps reduced and is therefore less costly.

It is to be noted that where the center of the reduced width portion 23, which defines the adjustment element 16*b*, in the widthwise direction is displaced relative to the center of the arm body 4B, the offset structure can be obtained in which the center of the adjustment element 16B and the center of the roller support structure for the roller 10 are displaced relative to each other in a direction of the pivotal center line.

A different embodiment of the rocker arm according to the third aspect of the present invention is shown in FIGS. 13 and 14A to 14D. This embodiment is such that in the third embodiment shown in and described with reference to FIGS. 10, 11 and 12A to 12C, only one of the side walls 5 is so configured as to provide the overlapped structure. The side wall 5 of the overlapped structure is made up of the first side wall forming plate segment 5A forming a portion continued from the connecting wall 6 and in the vicinity of the pivot support hole 7, and the second side wall forming plate segment 5B. The second side wall forming plate segment 5B extends integrally from the first side wall forming plate segment 5A and is bent so as to overlap the first side wall forming plate segment 5A with the roller support hole 11 defined at a rear end of the second side wall forming plate segment 5B. Other structural features of this embodiment are substantially similar to those shown and described in connection with the third embodiment.

In this embodiment, since the side wall 5 is so configured as to provide the overlapped structure, the strength of the side wall 5 can be increased. Also, since the roller support hole 11 is defined in the second side wall forming plate segment 5B externally overlapping the first side wall forming plate segment 5A in the side wall 5, the offset structure can be obtained in which the center of the adjustment element 16B and the center of the roller support structure 17 are displaced relative to each other in the direction of the pivotal center line.

It is to be noted that the overlapping between the first side wall forming plate segment 5A and the second side wall forming plate segment 5B in the side wall 5 may not necessarily be such that the both are held in tight contact with each other, but they may be slightly spaced to represent a generally U-shaped configuration with a gap therebetween. In such case, by suitably choosing the size of the gap between the first side wall forming plate segment 5A and the second side wall forming plate segment 5B, the amount of offset can be adjusted. Also, for the purpose of reinforcement, the opposite side walls 5 may be so configured to represent the overlapped structure.

FIGS. 15A to 15E illustrate another embodiment according to the third aspect of the present invention. The embodiment shown therein is such that in the embodiment shown in and described with reference to FIGS. 13 and 14A to 14D, the second side wall forming plate segment 5B of the side wall 5 of the overlapped structure has cutouts 41 and 42 formed respectively in upper and lower edges and positioned thereof between the pivot support hole 7 and the roller support hole 11. The cutouts 41 and 42 are preferably large to such an extent that a required strength can be obtained in the second side wall forming plate segment 5B.

Where the cutouts 41 and 42 are so formed as hereinabove described, the overall weight of the rocker arm 1B can further be reduced. Other structural features of and effects obtainable by this embodiment shown in FIGS. 15A to 15E are similar to those shown in and described with reference to FIGS. 13 and 14A to 14D.

FIGS. 16 to 18 and 19A to 19C illustrate one preferred embodiment of the rocker arm according to a fourth aspect of the present invention (Fourth Embodiment). A rocker arm 1C shown therein is of an end pivot type utilized on an internal combustion engine for actuating the valve 3 of the cylinder head when driven by the cam 2 so as to undergo a rocking motion. Even in this rocker arm 1C, an arm body 4C is prepared from a single plate material by the use of a press work so as to assume a generally inverted U-shaped section defined by the opposite side walls 5 and the connecting wall 6 straddling between respective upper edges of the opposite side walls 5. The plate material referred to above is, for example, a steel plate which may be of the same material as in and is heat-treated in the same manner as that used in the first embodiment. The arm body 4C has a side profile which may be either substantially straight or be angled, but in the embodiment shown therein it represents a generally straight profile. The opposite side walls 5 are symmetrical with respect to each other.

Figure 19A:
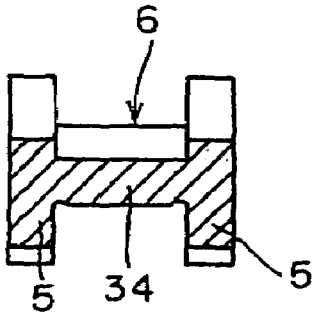
FIG. 19A is a cross-sectional view taken along the line A—A in FIG. 18.
Figure 19B:
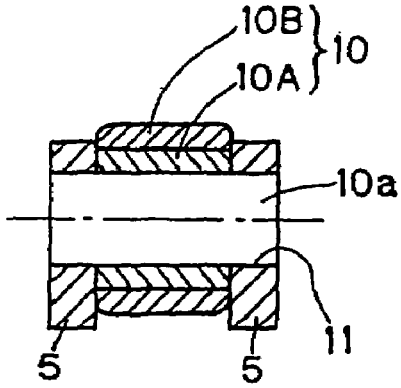
FIG. 19B is a cross-sectional view taken along the line B—B in FIG. 18.

The arm body 4C has the roller 10 rollingly engageable with the cam 2, which is mounted on a portion intermediate of the lengthwise direction thereof, and is formed at a front end 1Ca thereof with the valve driving member 34 that acts on the valve 3. The arm body 4C also has an opposite rear end 1Cb defining an adjustment element 16C which includes a female thread 15C threadably engageable with a male-threaded screw shank 31 formed on the pivot member 30 so that the pivot member 30 is fixedly inserted into the female thread 15C. The valve driving member 34 is defined by a portion of the connecting wall 6 and is, when viewed in a section in a direction lengthwise of the arm body 4C, so curved as to protrude towards the valve 3. The connecting wall 6 of the arm body 4C is defined in a portion of the entire length thereof in the lengthwise direction, excluding an intermediate portion thereof, while the intermediate portion is formed with the window 32 through which a portion of the roller 10 protrudes. A portion on one side of the front end 1Ca adjacent the window 32 forms the valve driving member 34. The roller 10 employed therein is similar to that employed in the previously described first embodiment and is of the double roller structure including, as shown in FIG. 19B, the inner and outer rollers 10A and 10B, wherein a contact area between the inner peripheral surface of the inner roller element 10A and the support pin 10*a* and a slide contact area between the outer peripheral surface of the inner roller element 10A and the inner peripheral surface of the outer roller 10B defines a respective plain bearing surface. Other than this, the roller 10 of the structure described above may be an outer race of a rolling bearing member as shown in FIG. 2B or a single roller type as is the case with that shown in FIG. 2C.

Figure 18:
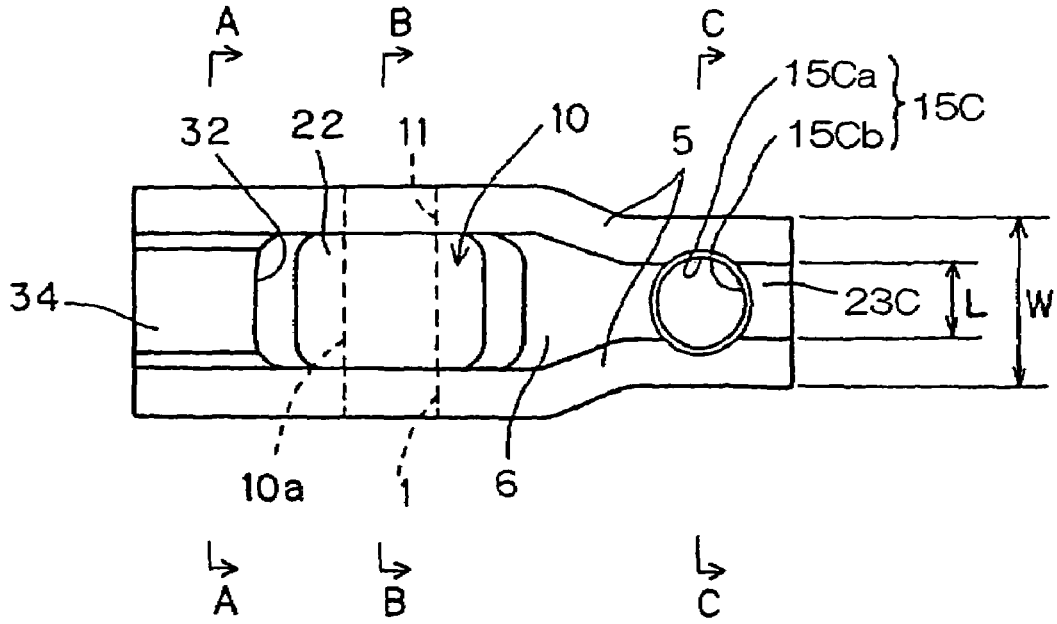
FIG. 18 is a bottom plan view of the rocker arm shown in FIG. 16.
Figure 19C:
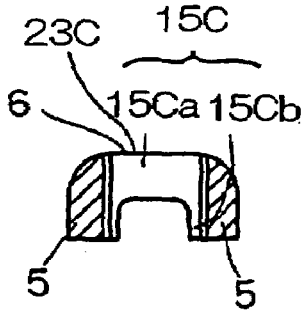
FIG. 19C is a cross-sectional view taken along the line C—C in FIG. 18.

The adjustment element 16C is similar to that of the third embodiment shown in and described with reference to FIGS. 10, 11 and 12A to 12C and is defined by a reduced width portion 23C of a generally inverted U-shaped section in which the width W thereof is smaller than that of the intermediate portion of the connecting wall 6 as shown in FIG. 18 and the distance L between the opposite side walls 5 is smaller than the inner diameter of the female thread 15C. As shown in FIG. 19C showing a cross-section taken along the line C—C in FIG. 18, the female thread 15C is made up of an internally threaded hole 15Ca extending through the reduced width portion 23C of the connecting wall 6, and partially threaded portions 15Cb formed respectively in the mutually confronting surfaces of the opposite side walls 5 in continuation with the internally threaded hole 15Ca. It is to be noted that the reduced width portion 23C suffices if the distance L is smaller than the diameter of the internally threaded hole 15Ca and the width of the reduced width portion 23C may be equal to that of the intermediate portion of the connecting wall 6.

Although the fourth embodiment differs from the third embodiment in that in this fourth embodiment a member fitted in the adjustment element 16C is the pivot member 30, the following effects similar to those afforded by the third embodiment can also be obtained. Specifically, in this rocker arm 1C, since the adjustment element 16C is defined by the reduced width portion 23C of the generally inverted U-shaped section, a necessary strength can be secured and, also, since the inverted U-shaped section is employed as is the case with the arm body 4C, processing is easy to achieve. The female thread 15C in which the pivot member 30 is fitted is made up of the internally threaded hole 15Ca formed in the connecting wall 6 forming a ceiling of the adjustment element 16C and the partially threaded portions 15Cb formed respectively in the mutually confronting surfaces of the opposite side walls 5 in continuation with the internally threaded hole 15Ca and, accordingly, the male thread 31 of the pivot member 30 can be threadingly engaged with the opposite side walls 5. Because of this, no use of, for example, any overlapped structure or wall of an increased thickness is needed for reinforcement of the internally threaded hole 15Ca. As such, by utilizing the opposite side walls 5 for threading engagement, both increase in strength and increase in processability can be obtained.

Figure 20:
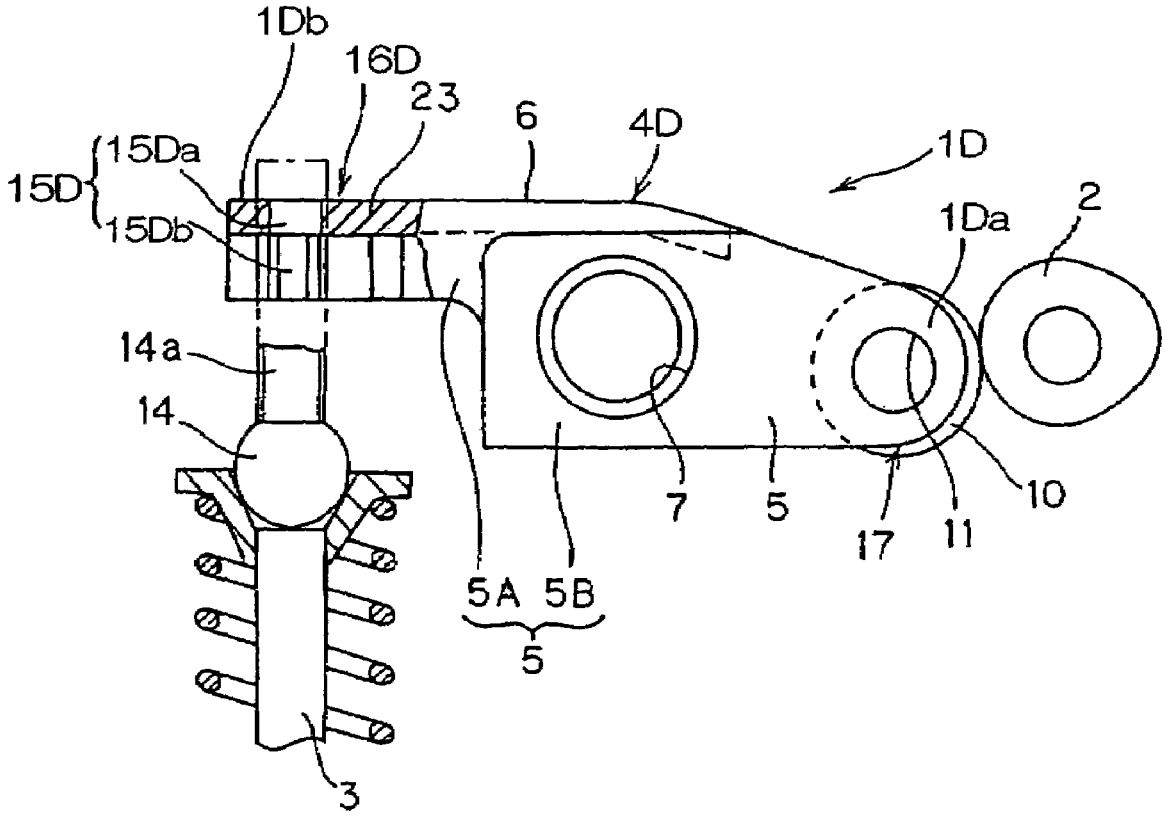
FIG. 20 is a front elevational view showing a first preferred embodiment of the rocker arm according to a fifth aspect of the present invention.
Figure 21:
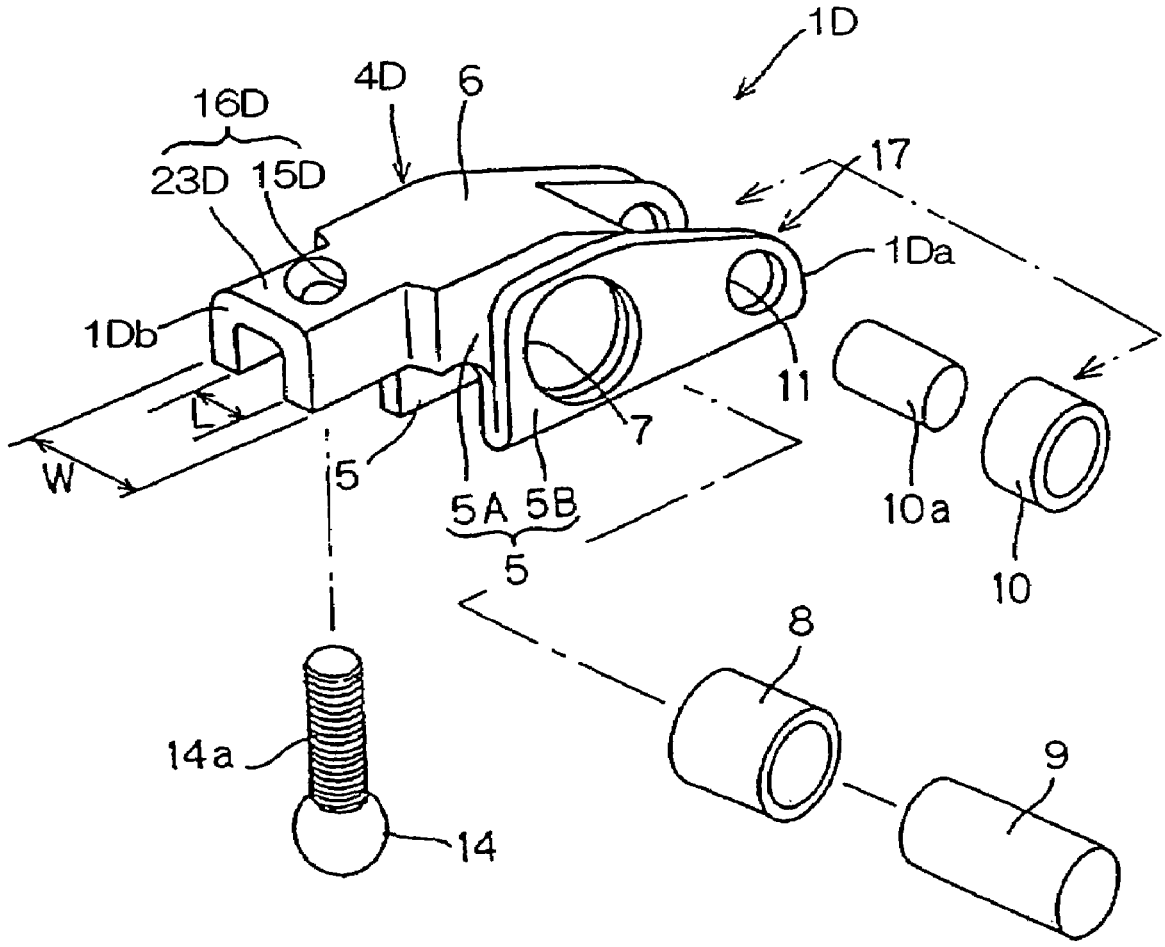
FIG. 21 is an exploded view of the rocker arm shown in FIG. 20, shown together with associated component parts.

One preferred embodiment of the rocker arm according to a fifth aspect of the present invention (Fifth Embodiment) will now be described with reference to FIGS. 20, 21 and 22A to 22D. As shown in FIG. 20, a rocker arm 1D is of a center pivot type utilized on an engine for opening and closing the valve 3 of the cylinder head by means of a front end 1Db thereof when an opposite rear end 1Da is driven by the cam 2 so as to undergo a rocking motion. As shown in FIG. 21, the rocker arm 1D shown therein includes an arm body 4D that is prepared from a single plate material by the use of a press work so as to assume a generally inverted U-shaped section defined by the opposite side walls 5 and the connecting wall 6 straddling between respective upper edges of the opposite side walls 5. The plate material referred to above is, for example, a steel plate. The arm body 4D has a side profile which may be either substantially straight or be angled, but in the embodiment shown therein it represents a generally straight profile. The connecting wall 6 is formed so as to extend in a range from a portion generally intermediate of the arm body 4D in the lengthwise direction thereof to the front end 1Db. The range in which the connecting wall 6 is formed in the lengthwise direction of the arm body 4D may be arbitrarily chosen so long as it extends to the front end 1Db without being interfered by the roller 10.

The arm body 4D has the pivot support hole 7, defining a fulcrum about which the rocker arm 1D undergoes a rocking motion, at a portion intermediate of the lengthwise direction thereof, and the roller 10 rollingly engageable with the cam 2 is rotatably mounted on the rear end 1Da thereof while an adjustment element 16D having a female thread 15D threadingly engageable with a male thread 14*a* of the valve driving member 14 is formed in the front end 1Db of the arm body 4D. The pivot support hole 7 is defined in each of the opposite side walls 5. The pivot support pin 9 is engaged in the pivot support holes 7 through respective bushings 8. The rocker arm 1D is supported for rocking motion about the pivot support pin 9 in respective directions opposite to each other. The bushings 8 are, for example, press-fitted into the respective pivot support holes 7. Respective end portions of the side walls 5 adjacent the rear end 1Da of the cam body 4D are formed with roller support holes 11 for supporting the support pin 10*a* with opposite ends of the latter engaged in the support holes 11, and the roller 10 is rotatably mounted on the support pin 10*a* for engagement with the cam 2. Those end portions of the side walls 5 adjacent the rear end 1Da of the cam body 4D and the support pin 10*a* journalled thereby altogether constitute the roller support structure 17

One of the opposite side walls 5 of the arm body 4D is so configured as to provide the overlapped structure with a portion of the plate material turned backwards. The side wall 5 of the overlapped structure is made up of the first side wall forming plate segment 5A forming a portion continued from the connecting wall 6 and in the vicinity of the pivot support hole 7, and the second side wall forming plate segment 5B. The second side wall forming plate segment 5B extends integrally from the first side wall forming plate segment 5A and is bent so as to overlap the first side wall forming plate segment 5A with the roller support hole 11 defined at a rear end of the second side wall forming plate segment 5B. The pivot support hole 7 is formed in each of the first side wall forming plate segment 5A and the second side wall forming plate segment 5B and the pivot support holes 7 respectively defined in those plate segments 5A and 5B are aligned with each other. The pivot support pin 9 referred to above is also engaged in a portion of the second side wall forming plate segment 5B at the pivot support hole 7 through a bushing 8.

Figure 22A:
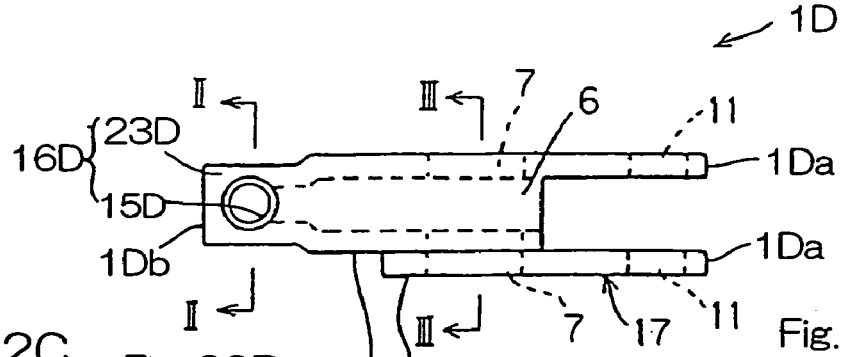
FIG. 22A is a plan view of the rocker arm shown in FIG. 20.
Figure 22C:
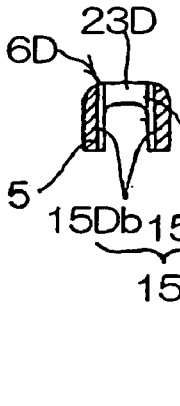
FIG. 22C is a cross-sectional view taken along the line II—II in FIG. 22A.
Figure 22B:
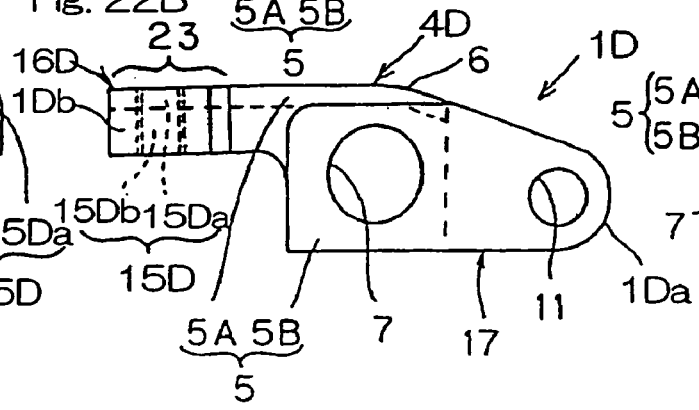
FIG. 22B is a front elevational view of the rocker arm shown in FIG. 20.
Figure 22D:
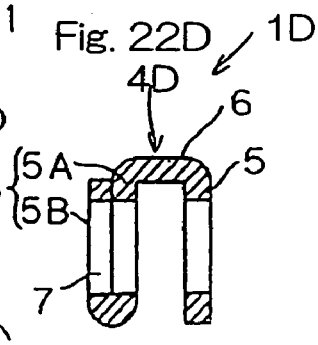
FIG. 22D is a cross-sectional view taken along the line III—III in FIG. 22A.
Figure 23A:
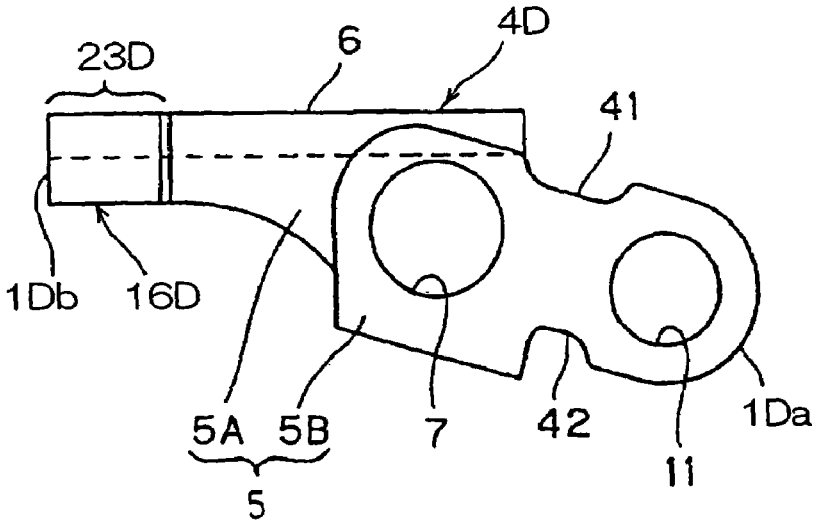
FIG. 23A is a front elevational view of the arm body, showing a second preferred embodiment of the rocker arm according to the fifth aspect of the present invention.
Figure 23B:
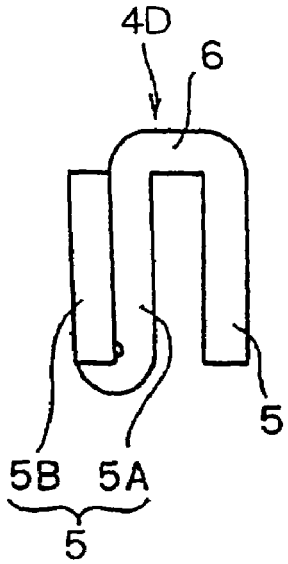
FIG. 23B is a sectional view of the arm body shown in FIG. 23A, when viewed from the right side.
Figure 23C:
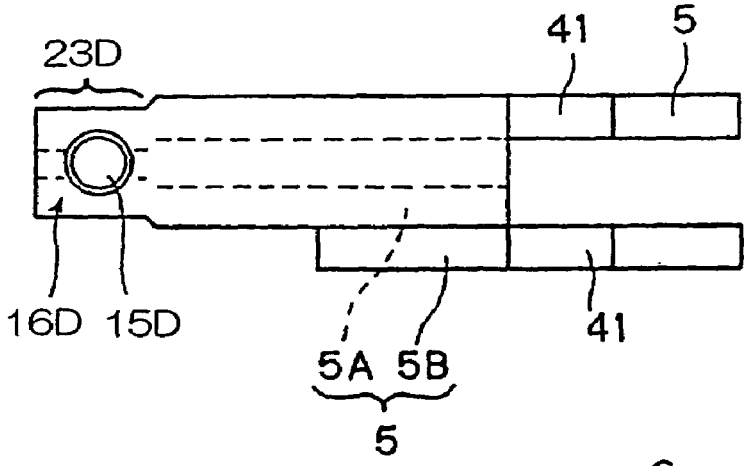
FIG. 23C is a plan view of the arm body shown in FIG. 23A.
Figure 23D:
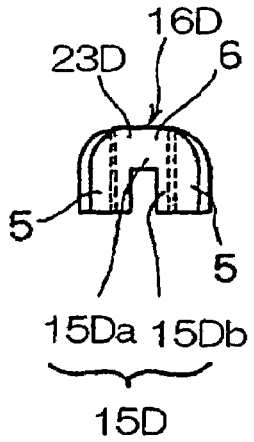
FIG. 23D is a sectional view of the arm body shown in FIG. 23A, when viewed from the left side.
Figure 23E:
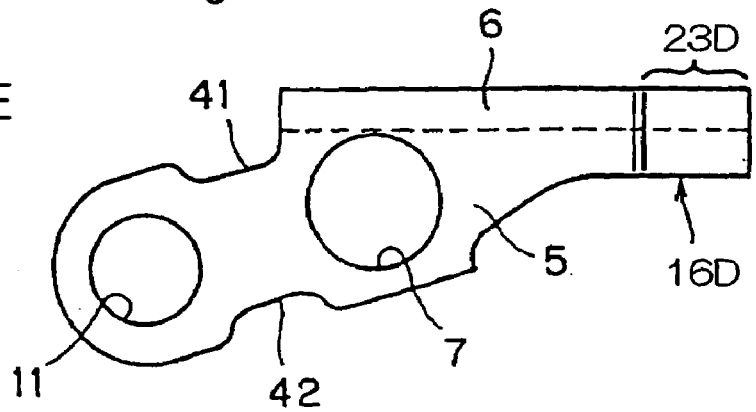
FIG. 23E is a rear view of the arm body shown in FIG. 23A

As shown in FIG. 21, the adjustment element 16D is defined by a reduced width portion 23D of a generally inverted U-shaped section in which the width W thereof is smaller than that of the intermediate portion of the connecting wall 6 and the distance L between the opposite side walls 5 is smaller than the inner diameter of the female thread 15D. As shown in FIG. 22C showing a cross-section taken along the line II—II in FIG. 22A, the female thread 15D is made up of an internally threaded hole 15Da extending through the reduced width portion 23D of the connecting wall 6, and partially threaded portions 15Db formed respectively in the mutually confronting surfaces of the opposite side walls 5 in continuation with the internally threaded hole 15Da. It is to be noted that the reduced width portion 23D in this embodiment has its center in the widthwise direction thereof aligned with the center of the arm body 4D in the widthwise direction, but the center of the reduced width portion 23D may be displaced in either one of the opposite lateral directions relative to the center of the arm body 4D in the widthwise direction. It is also to be noted that the reduced width portion 23D suffices if the distance L (FIG. 21) is smaller than the diameter of the internally threaded hole 15Da and the width of the reduced width portion 23D may be equal to or greater than that of the intermediate portion of the connecting wall 6.

It is to be noted that the roller 10 employed in this embodiment may be the same as that shown and described in connection with the first embodiment.

In this rocker arm 1D, since that portion of the side wall 5 adjacent the pivot support hole 7 is of the overlapped structure, the strength in the vicinity of the pivot support hole 7 where a strength is required can be secured with no need to increase the plate thickness. Because of this, the portion of the connecting wall 6 where a requirement for the strength is relatively low will not unnecessarily increase in thickness and, therefore, a sufficient strength can be secured in the vicinity of the pivot support hole 7 while the weight of the arm body 4D and the material used to form the arm body 4D are both reduced. Since the use of the overlapped structure is sufficient, processing required to increase the strength is quite simple.

Also, since the roller support hole 11 is defined in the second side wall forming plate segment 5B externally overlapping the first side wall forming plate segment 5A of the side wall 5, the offset structure can be obtained in which the center of the adjustment element 16D and the center of the roller support structure 17 are displaced in a direction of the pivot support pin. Moreover, the amount of offset between the adjustment element 16D and the roller support structure 17 can be indefinitely adjusted without changing the width of a main portion of the arm body 4D and, accordingly, the amount of offset can be increased without being accompanied by a considerable increase of the weight of the rocker arm 1D.

It is to be noted that the overlapping between the first side wall forming plate segment 5A and the second side wall forming plate segment 5B in the side wall 5 may not necessarily be such that both are held in tight contact with each other, but they may be slightly spaced to represent a generally U-shaped configuration with a gap therebetween. In such case, by suitably choosing the size of the gap between the first side wall forming plate segment 5A and the second side wall forming plate segment 5B, the amount of offset can be adjusted.

Also, since the rocker arm 1D in this embodiment is prepared from a single plate material by the use of a press work, it is light-weight and inexpensive and the number of manufacturing steps is reduced.

In the fifth embodiment described hereinabove, the adjustment 16D is defined by the reduced width portion 23D of the generally inverted U-shaped section having the female thread 15D defined therein and this female thread 15D is made up of the internally threaded hole 15Da defined in the connecting wall 6 forming a ceiling of the adjustment element 16D and the partially threaded portions 15Db defined in the mutually confronting surfaces of the respective side walls 5 in continuation with the internally threaded hole 15Da. Accordingly, the male thread 14*a* of the valve driving member 14 can threadingly engage not only the internally threaded hole 15Da, but also the partially threaded portions 15Da in the respective side walls 5. Because of this, a threading strength of the female thread 15D for receiving the valve driving member 14 can be secured. Also, since the adjustment element 16D is defined by the reduced width portion 23D of the generally inverted U-shaped section as is the case with the arm body 4D, processing can be easily achieved. In particular, in view of the overlapped structure employed in one of the side walls 5, processing to reinforce various portions can be achieved all at a time while the arm body 4D is prepared from the single plate material.

Another embodiment of the rocker arm according to the fifth aspect of the present invention is shown in FIGS. 23A to 23E. The embodiment shown therein is such that in the fifth embodiment shown in and described with reference to FIGS. 20, 21 and 22A to 22D the second side wall forming plate segment 5B of the side wall 5 of the overlapped structure has the cutouts 41 and 42 formed respectively in upper and lower edges thereof and positioned between the pivot support hole 7 and the roller support hole 11. The cutouts 41 and 42 are preferably large to such an extent that a required strength can be obtained in the second side wall forming plate segment 5B.

Where the cutouts 41 and 42 are so formed as hereinabove described, the overall weight of the roller arm 1D can further be reduced. Other structural features of and effects obtainable by this embodiment shown in FIGS. 23A to 23E are similar to those shown in and described in connection with the previously described fifth embodiment.

Figure 24A:
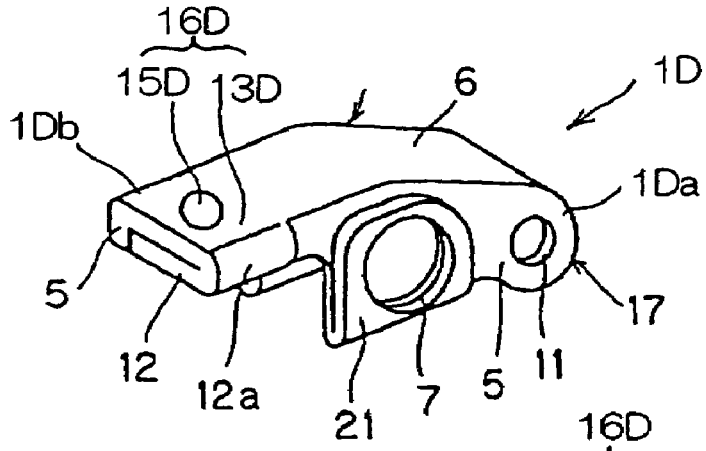
FIG. 24A to 24D are perspective views, showing third to sixth preferred embodiments of the rocker arm according to the fifth aspect of the present invention, respectively.

A different embodiment of the rocker arm according to the fifth aspect of the present invention is shown in FIG. 24A. This embodiment shown therein is such that in the fifth embodiment shown in and described with reference to FIGS. 20, 21 and 22A to 22D the side walls 5 and the adjustment element 16D of the arm body 4D are constructed as follows. Specifically, each of the opposite side walls 5 is provided with the side overlap piece 21 extending integrally from the respective side wall 5, which is then bent to overlap the respective side wall 5 to thereby define the overlapped structure. The side overlap piece 21 is of a size sufficient to encompass a range of the respective side wall 5 adjacent the pivot support hole 7 and extends integrally downwardly from the respective side wall 5 and is then bent outwardly to overlap the respective side wall 5. This overlapped structure defined by the side overlap piece 21 is formed in each of the opposite side walls 5.

On the other hand, the adjustment element 16D is defined by an overlapped structure 13D formed by providing a portion of the connecting wall 6 at the front end 1Db of the arm body 4D with the end overlap piece 12 extending integrally from a side edge of the connecting wall 6 and then bending the end overlap piece 12 so as to overlap the connecting wall 6, and the female thread 15D in which the valve driving member 14 (FIG. 20) is adjustably engaged is so defined as to extend through the overlapped structure 13D. The end overlap piece 12 extends integrally from one side edge of the front end of the connecting wall 6 and is bent at the one side edge to form the bent base end 12*a* so as to overlap the connecting wall 6. A free end of the end overlap piece 12 is held in tight contact with or held in the vicinity of the inner surface of one of the opposite side walls remote from the bent base end 12*a*.

It is to be noted that the connecting wall 6 of the arm body 4D extends to a portion adjacent the rear end 1Da of the arm body 4D. Other structural features of the rocker arm 1D in this embodiment are similar to those according to the fifth embodiment.

In the case of the rocker arm 1D of the above described structure, the side overlap piece 21 provided locally in the vicinity of the pivot support hole 7 is bent to provide the overlapped structure in the vicinity of the pivot support hole 7, with the roller support hole 11 positioned in the main portion of the side wall 5. Because of this, formation of the overlapped structure does not necessarily result in an offset structure and a region of the side wall 5 in the vicinity of the pivot support hole 7 can be advantageously reinforced.

Also, since the adjustment element 16D is defined by the overlapped structure 13D in which the end overlap piece 12 is bent to overlap the connecting wall 6, a sufficient depth can be obtained in the female thread 15D that extends through the adjustment element 16D and, therefore, that portion of the adjustment element 16D around the female thread 15D can have a sufficient strength. In such case, since the adjustment element 16D can be formed merely by providing that portion defining the end overlap piece 12 and then bending it to overlap the connecting wall 6, reinforcement can easily be accomplished.

The female thread 15D defined in the adjustment element 16D may be disposed at a location aligned with the center of the connecting wall 6 in the widthwise direction or may be displaced relative to such widthwise center. By this displacement, the center of the adjustment element 16D and the center of the roller support structure 17 of the arm body 4D can be offset in a direction of the pivot support pin about which the rocker arm 1D undergoes the rocking motion. Where this offset structure is employed, since no accessory portion such as the conventionally employed cylindrical bulged portions 56 (See FIG. 30) is employed around the female thread 15D, the amount of offset can easily be secured. Also, since this rocker arm 1D in this embodiment is prepared from the single plate material by the use of the press work, it is light-weight and less costly with the number of processing steps minimized.

Each of the examples shown in FIGS. 24B to 24D and 25A to 25D is such that the following structure is employed in the embodiment shown in and described with reference to FIG. 24A.

Figure 24B:
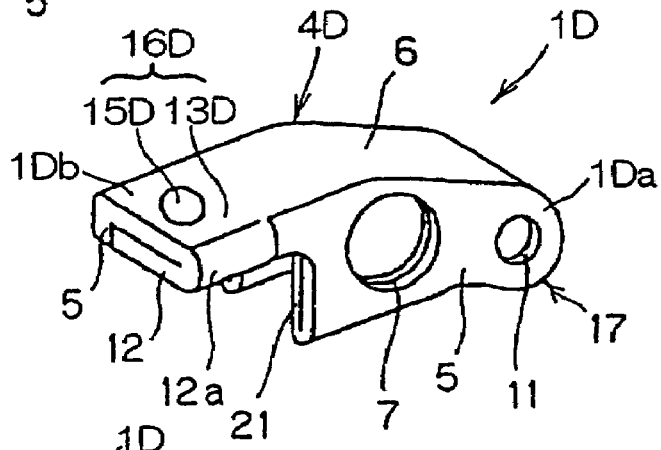

Specifically, the example shown in FIG. 24B is such that in the example shown in FIG. 24A, in place of the side overlap piece 21 being externally bent so as to overlap the outer surface of the respective side wall 5, it is internally bent so as to overlap an inner surface of the respective side wall 5.

Figure 24C:
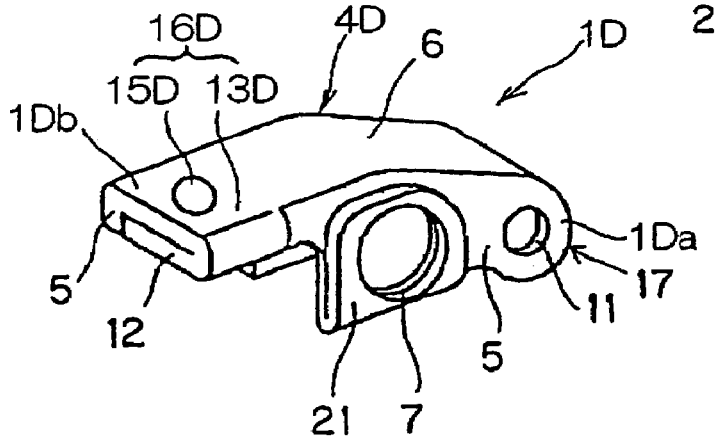
Figure 24D:
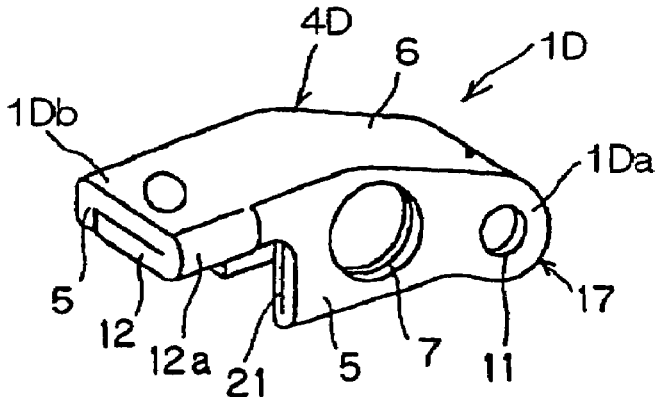

Each of the examples shown respectively in FIGS. 24C and 24D is such that in each of the examples shown respectively in FIGS. 24A and 24B, in place of the opposite side walls 5 being so configured as to represent the overlapped structures, only one of the side walls 5 is configured to represent the overlapped structure.

Figure 25A:
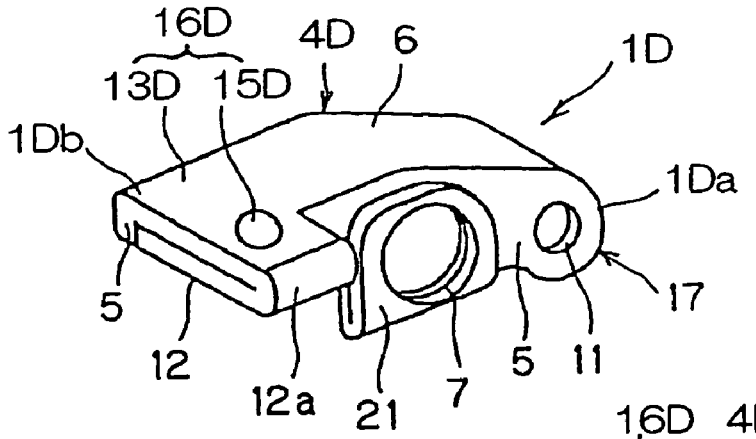
FIGS. 25A to 25D are perspective views showing seventh to tenth preferred embodiments of the rocker arm according to the fifth aspect of the present invention, respectively.

The example shown in FIG. 25A is such that the overlapped structure 13D of the adjustment element 16D is so shaped as to extend in one lateral direction from the connecting wall 6 and, on the other hand, the width of the overlapped structure 13D as measured in the widthwise direction of the connecting wall 6 is made larger than that of the connecting wall 6 and the side overlap piece 21 is employed as is the case with the example of FIG. 24A to thereby render the side wall 5 to represent the overlapped structure.

Figure 25B:
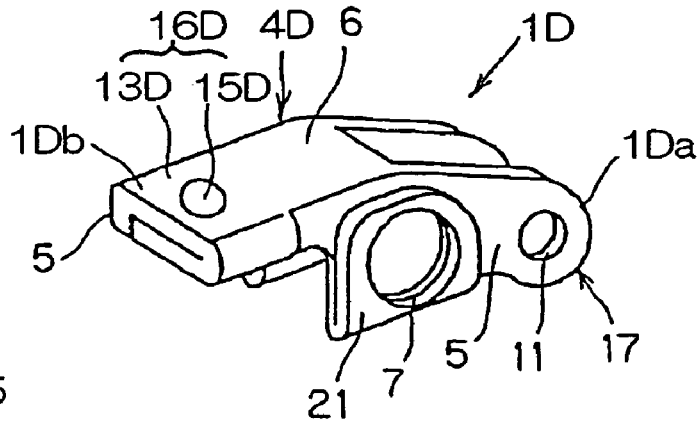

The example shown in FIG. 25B is such that in the embodiment of FIG. 24A the connecting wall 6 is provided only in a region from a portion generally intermediate of the arm body 4D in the lengthwise direction to the adjustment element 16D.

Figure 25C:
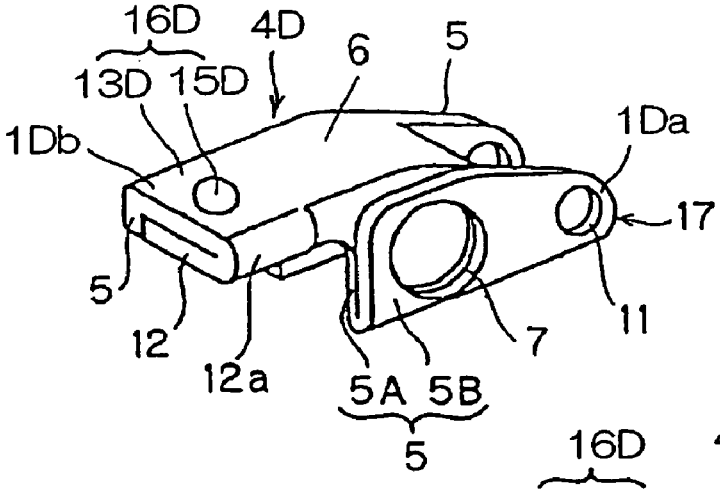

The example shown in FIG. 25C is such that in the embodiment according to the fifth aspect of the present invention shown in and described with reference to FIGS. 20 to 23, that is, in the embodiment in which the side wall 5 is constructed of the first side wall forming plate segment 5A and the second side wall forming plate segment 5B, the adjustment element 16D is so configured as to provide the overlapped structure 13 in a manner similar to that employed in the example of FIG. 24A.

Figure 25D:
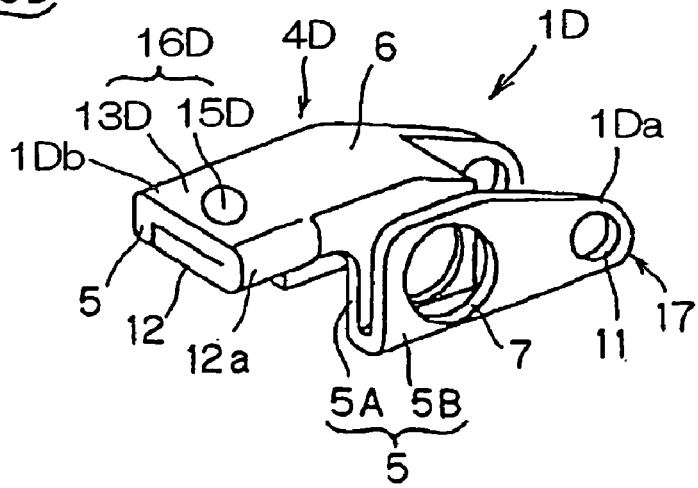
Figure 26:
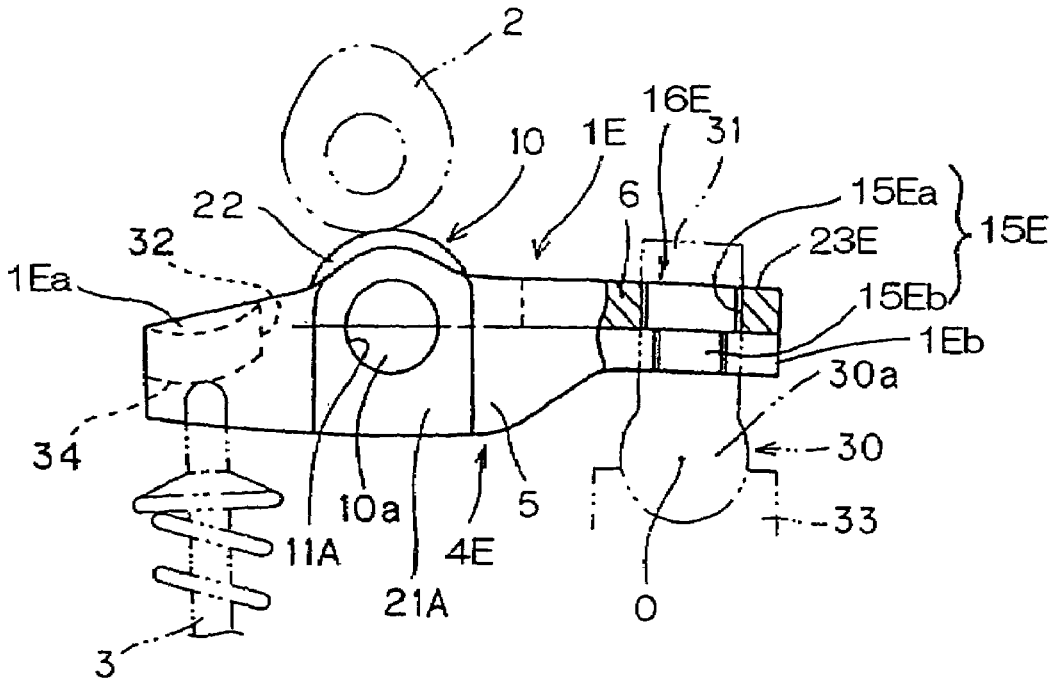
FIG. 26 is a front elevational view showing a first preferred embodiment of the rocker arm according to a sixth aspect of the present invention.
Figure 27:
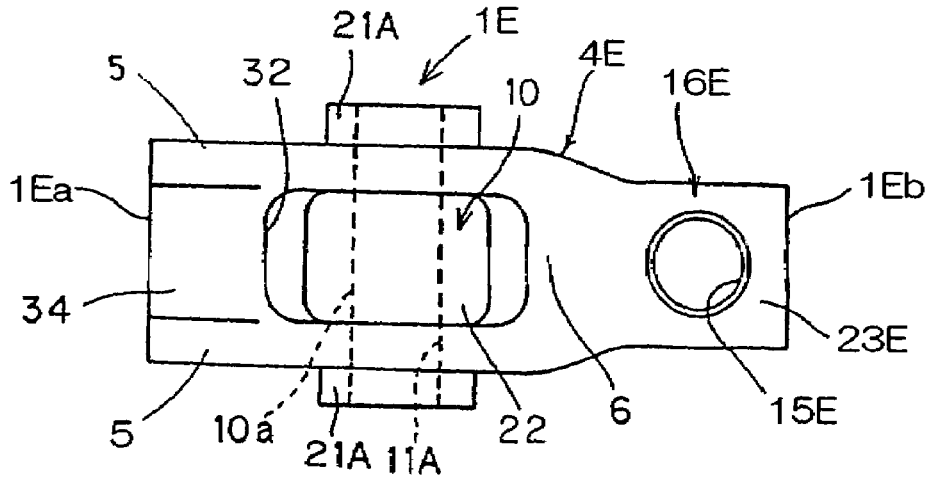
FIG. 27 is a plan view of the rocker arm shown in FIG. 26.
Figure 28:
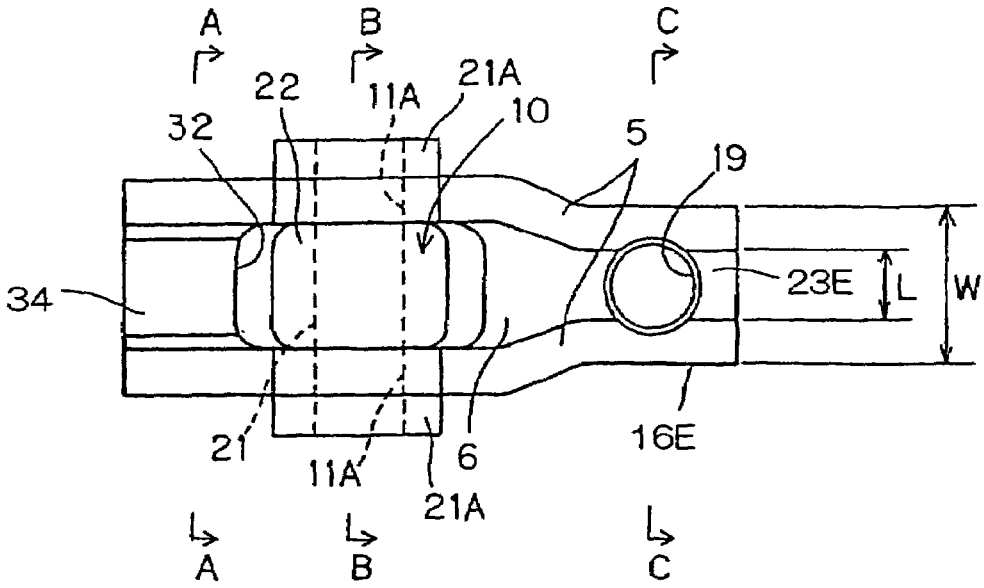
FIG. 28 is a bottom plan view of the rocker arm shown in FIG. 26.

The example shown in FIG. 25D is such that in the example shown in FIG. 25C the first side wall forming plate segment 5A and the second side wall forming plate segment 5B are separated in a direction of the pivot support pin about which the rocker arm undergoes the rocking motion, so that the offset structure can be obtained in which the center of the adjustment element 16D and the center of the roller support structure 17 are displaced with each other in the direction of the pivot support pin.

FIGS. 26 to 28 and 29A to 29C illustrate a preferred embodiment of the rocker arm according to a sixth aspect of the present invention (Sixth Embodiment). A rocker arm 1E shown therein is of an end pivot type utilized on an internal combustion engine for actuating the valve 3 of the cylinder head when driven by the cam 2 so as to undergo a rocking motion. Even in this rocker arm 1E, an arm body 4E is prepared from a single plate material by the use of a press work so as to assume a generally inverted U-shaped section defined by the opposite side walls 5 and the connecting wall 6 straddling between respective upper edges of the opposite side walls 5. The plate material referred to above is, for example, a steel plate which may be of the same material as that used in any one of the previously described embodiments and is heat-treated. The arm body 4E has a side profile which may be either substantially straight or be angled, but in the embodiment shown therein it represents a generally straight profile. The opposite side walls 5 are symmetrical with respect to each other.

The arm body 4E has the roller 10 rollingly engageable with the cam 2 in the lengthwise direction of the arm body 4E, and has a front end 1Ea formed with the valve driving member 34 that acts on the valve 3 and the opposite rear end 1Eb formed with an adjustment element 16E having a female thread 15E threadingly engageable with a male thread 31 of the pivot member 30 for receiving the latter therein. The arm body 4E is of a design in which at least a portion of the opposite side walls 5 represents an overlapped structure in which a portion of the plate material is overlapped. This overlapped structure is defined by providing side overlap pieces 21A extending integrally from the opposite side walls 5, respectively, and then bending the side overlap pieces 21A so as to overlap the associated side walls 5. The range of the opposite side walls 5 in which the overlapped structure is defined is in the vicinity of a roller support hole 11A in the illustrated embodiment. It is, however, to be noted that the above described overlapped structure may be employed only in one of the opposite side walls 5.

Figure 29A:
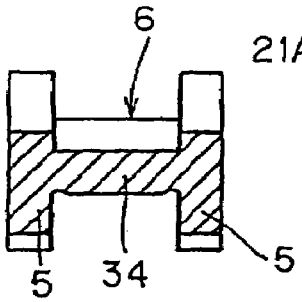
FIG. 29A is a cross-sectional view taken along the line A—A in FIG. 28.
Figure 29B:
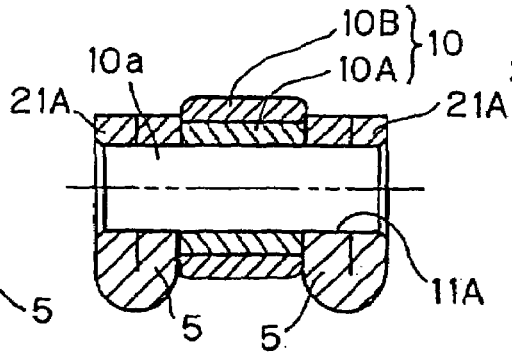
FIG. 29B is a cross sectional view taken along the line B—B in FIG. 28.

The valve driving member 34 is defined by a portion of the connecting wall 6 and is, when viewed in a section in a direction lengthwise of the arm body 4E, so curved as to protrude towards the valve 3. The connecting wall 6 of the arm body 4E is defined in a portion of the entire length thereof in the lengthwise direction, excluding an intermediate portion thereof, while the intermediate portion is formed with the window 32 through which a portion of the roller 10 protrudes. A portion on one side of the window 32 adjacent the front end 1Ea defines the valve driving member 34 discussed above. The roller 10 employed therein is similar to that employed in the previously described first embodiment and is of a double roller structure including, as shown in FIG. 29B, the inner and outer rollers 10A and 10B, wherein a contact area between the inner peripheral surface of the inner roller element 10A and the support pin 10*a* and a slide contact area between the outer peripheral surface of the inner roller element 10A and the inner peripheral surface of the outer roller 10B defines a respective plain bearing surface. Other than this, the roller 10 of the structure described above may be an outer race of a rolling bearing member as shown in FIG. 2B or a single roller type.

Figure 29C:
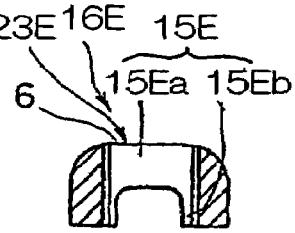
FIG. 29C is a cross-sectional view taken along the line C—C in FIG. 28.

The adjustment element 16E is similar to that shown in and described with reference to FIGS. 20, 21 and 22A to 22D and is defined by a reduced width portion 23E of a generally inverted U-shaped section in which the width W thereof is smaller than that of the intermediate portion of the connecting wall 6 and the distance L between the opposite side walls 5 is smaller than the inner diameter of the female thread 15E. As shown in FIG. 29C showing a cross-section taken along the line C—C in FIG. 28, the female thread 15E is made up of an internally threaded hole 15Ea extending through the reduced width portion 23E of the connecting wall 6, and partially threaded portions 15Eb formed respectively in the mutually confronting surfaces of the opposite side walls 5 in continuation with the internally threaded hole 15Ea. It is to be noted that the reduced width portion 23E suffices if the distance L is smaller than the diameter of the female thread 15E and the width of the reduced width portion 23E may be equal to that of the intermediate portion of the connecting wall 6.

Although the sixth embodiment differs from the fifth embodiment in that in this sixth embodiment a member fitted in the adjustment element 16E is the pivot member 30, the following effects similar to those afforded by the fifth embodiment can also be obtained. Specifically, in this rocker arm 1E, a sufficient strength of that portion of the arm body 4E around the roller support hole 11A, defined in the opposite side wall 5, where a sufficient strength is required can be secured without the plate thickness being increased. Because of this, the thickness of the portion of the connecting wall 6 where the strength requirement is relatively low will not unnecessarily increase and, therefore, the sufficient strength can be secured while the arm body 4E is reduced in weight with the amount of material being reduced. Also, since the use of the overlapped structure is sufficient, processing to increase the strength can also be simplified. With respect to the adjustment element 16E, since it is defined by the reduced width portion 23E of the generally inverted U-shaped section and the female thread 15E is made up of the internally threaded hole 15Ea defined in the connecting wall 6 and the partially threaded portions 15Eb defined in the opposite side walls 5, securement of a sufficient strength of the threaded engagement portion can be attained with a simplified processing.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, in describing the various preferred embodiments of the present invention, the arm body employed in each of those embodiments has been shown and described as having a generally inverted U-shaped configuration. However, the arm body that can be employed in the rocker arm within the framework of the present invention may be of a generally U-shaped configuration.

Accordingly, such changes and modifications are, unless they depart from the scope of the present invention as delivered from the claims annexed hereto, to be construed as included therein.

What is claimed is:

1. A rocker arm capable of being rocked by a cam to actuate a valve of an internal combustion engine, said rocker arm comprising:

an arm body prepared from a single plate material by means of a press work and having a length and a width, said arm body including a pair of side walls opposite to each other and a connecting wall bridging between the opposite side walls and also having a pivot support portion, defined at a location generally intermediate of the length of the arm body, about which the rocker arm undergoes a rocking motion, and first and second ends opposite to each other;

a roller rotatably mounted on the first end of the arm body and engageable with the cam; and an overlapped structure including an end overlap piece formed integrally with a side portion of the connecting wall adjacent the second end of the arm body, said end overlap piece being bent backwardly to overlap the connecting wall to thereby define an adjustment element, said adjustment element having a mounting hole defined therein for adjustably receiving therein a valve driving member.

2. The rocker arm as claimed in claim 1, wherein said mounting hole is displaced relative to a center of the connecting wall in a widthwise direction thereof.

3. The rocker arm as claimed in claim 1, wherein said overlapped structure has a width as defined in a direction widthwise of the connecting wall, the width of the overlapped structure being increased to a value greater than that of the connecting wall.

4. The rocker arm as claimed in claim 1, wherein the end overlap piece overlapping the connecting wall is welded to the connecting wall.

5. The rocker arm as claimed in claim 1, wherein the mounting hole is an internally threaded hole.

6. The rocker arm as claimed in claim 1, wherein at least a portion of one or both of the side walls of the arm body is configured to represent an overlapped structure defined by bending a portion of the plate material.

7. A rocker arm capable of being rocked by a cam to actuate a valve of an internal combustion engine, said rocker arm comprising:

an arm body prepared from a single plate material by means of a press work and having a length and a width, said arm body including a pair of side walls opposite to each other and a connecting wall bridging between the opposite side walls and also having a pivot support portion, defined at a location generally intermediate of the length of the arm body, about which the rocker arm undergoes a rocking motion, and first and second ends opposite to each other;

a roller rotatably mounted on the first end of the arm body and engageable with the cam;

a valve driving member;

an adjustment element formed on the second end of the arm body for adjustably receiving the valve driving member therein; and at least a portion of one or both of the opposite side walls adjacent the pivot support portion being configured to represent an overlapped structure formed by bending a portion of the plate material.

8. The rocker arm as claimed in claim 7, wherein the side wall of the overlapped structure includes a first side wall forming plate segment continued from the connecting wall and defining that portion of the side wall adjacent the pivot support portion, and a second side wall forming plate segment extending integrally from the first side wall forming plate segment and bent to overlap the first side wall forming plate segment, with a roller support hole defined in a free end of the second side wall forming plate segment for supporting the roller.

9. The rocker arm as claimed in claim 7, wherein the overlapped structure of the side wall is formed by providing a side overlap piece extending integrally from the side wall and then bending the side overlap piece to overlap the side wall.

10. The rocker arm as claimed in claim 8, wherein the first side wall forming plate segment and the second side wall forming plate segment are separated in a direction axial of the pivot support portion in the arm body.

* * * * *